US005914739A

United States Patent [19]

Zhang

[11] Patent Number: 5,914,739

[45] Date of Patent: Jun. 22, 1999

[54] INK JET APPARATUS

[75] Inventor: Qiming Zhang, Nagoya, Japan

[73] Assignee: Brother Kogyo Kabushiki Kaisha, Nagoya, Japan

[21] Appl. No.: 08/767,523

[22] Filed: Dec. 16, 1996

Related U.S. Application Data

[63] Continuation of application No. 08/158,530, Nov. 29, 1993, abandoned.

[30] Foreign Application Priority Data

Feb. 10, 1993 [JP] Japan ..... 5-022571

[51] Int. Cl.[6] ..... B41J 2/045

[52] U.S. Cl. ..... 347/71; 347/68

[58] Field of Search ..... 347/20, 18, 68–72, 347/65

[56] References Cited

U.S. PATENT DOCUMENTS

| | | | |
|---|---|---|---|
| 4,334,234 | 6/1982 | Shirato et al. | 347/65 |
| 4,520,374 | 5/1985 | Koto | 347/48 |
| 4,730,197 | 3/1988 | Raman et al. | 347/40 |
| 4,819,014 | 4/1989 | Yasuhara et al. | 347/68 |
| 4,879,568 | 11/1989 | Bartky et al. | 347/69 |
| 4,887,100 | 12/1989 | Michaelis et al. . | |
| 5,016,028 | 5/1991 | Temple | 347/69 |
| 5,184,155 | 2/1993 | Yonekubo et al. | 347/68 |
| 5,359,354 | 10/1994 | Hiraishi et al. | 347/69 |
| 5,363,133 | 11/1994 | Sugahara et al. | 347/69 |
| 5,396,042 | 3/1995 | Ishida et al. | 347/70 X |
| 5,421,071 | 6/1995 | Kanegae et al. | 347/69 X |

FOREIGN PATENT DOCUMENTS

| | | | |
|---|---|---|---|
| 0 364 136 | 4/1990 | European Pat. Off. | B41J 2/045 |
| 0 364 136 A2 | 4/1990 | European Pat. Off. . | |
| 0426473 | 5/1991 | European Pat. Off. . | |
| 0 513 971 | 11/1992 | European Pat. Off. | B41J 2/045 |
| 0 513 971 A2 | 11/1992 | European Pat. Off. . | |
| 0 522 814 A2 | 1/1993 | European Pat. Off. . | |
| 53-12138 | 4/1978 | Japan . | |
| 59-187871 | 10/1984 | Japan . | |
| 61-59914 | 12/1986 | Japan . | |
| 4-158044 | 6/1992 | Japan | 347/20 |

OTHER PUBLICATIONS

*Dynamics of Viscous Fluid*; Takefumi Ikui and Masahiro Inoue; Rikogaku–sha;, p. 206, Apr. 15, 1978.

*Primary Examiner*—Benjamin R. Fuller
*Assistant Examiner*—Craig A. Hallacher
*Attorney, Agent, or Firm*—Oliff & Berridge, PLC

[57] ABSTRACT

An ink jet apparatus includes a plurality of ink chambers each having a front end and a rear end, a manifold provided to introduce ink into each ink chamber with a front side surface on a side near the front end of each ink chamber, and a nozzle provided at the front end of each ink chamber. Ink is jetted from the nozzle by applying pressure to the ink contained in each ink chamber. A position of the manifold is such that a distance between the front side surface of the manifold and the rear end of each ink chamber is set to 0.2 mm or more, and a distance between the front side surface of the manifold and the nozzle is set to 3 mm or more. Accordingly, pressure necessary for jetting ink droplets can be maintained for a relatively long period of time. Therefore, the ink can be smoothly introduced from the manifold into each ink chamber, thereby improving print quality.

29 Claims, 17 Drawing Sheets

Fig.13

| PIEZOELECTRIC CERAMICS PLATE | | COVER PLATE | | DIFFERENCE IN COEFFICIENT OF LINEAR EXPANSION (ppm/°c) | LIFE (x $10^8$) |
|---|---|---|---|---|---|
| MATERIAL | COEFFICIENT OF LINEAR EXPANSION (ppm/°c) | MATERIAL | COEFFICIENT OF LINEAR EXPANSION (ppm/°c) | | |
| PZT1 | 1.0 | PZT1 | 1.0 | 0.0 | >30.0 |
| PZT1 | 1.0 | PZT2 | 2.0 | 1.0 | >30.0 |
| PZT1 | 1.0 | PZT3 | 4.0 | 3.0 | >30.0 |
| PZT3 | 4.0 | ZIRCONIA | 9.5 | 5.5 | >30.0 |
| PZT2 | 2.0 | ALUMINA | 8.0 | 6.0 | 30.0 |
| PZT1 | 1.0 | ALUMINA | 8.0 | 7.0 | 26.8 |
| PZT1 | 1.0 | ZIRCONIA | 9.5 | 8.5 | 20.1 |
| PZT3 | 4.0 | MAGNESIA | 13.8 | 9.8 | 17.5 |
| PZT2 | 2.0 | MAGNESIA | 13.8 | 11.8 | 8.2 |
| PZT1 | 1.0 | MAGNESIA | 13.8 | 12.8 | 2.2 |

PRIOR ART

PRIOR ART

PRIOR ART

INK JET APPARATUS

This is a Continuation of application Ser. No. 08/158,530 filed Nov. 29, 1993, now abandoned.

BACKGROUND OF THE INVENTION

1. Field of the Invention

The present invention relates to an ink jet apparatus that prints by ejecting ink droplets under pressure from nozzles.

2. Description of the Related Art

Traditional impact printers are now being replaced with non-impact printers, and the market of the non-impact printers is being expanded. One known kind of non-impact printers is an ink jet printer simple in principle and that can easily effect multi-scale or color printing. Of all of the types of ink jet printers, a drop-on-demand type ink jet printer capable of jetting ink droplets at a required time during printing has rapidly spread owing to its good jetting efficiency and its low running cost.

Typical examples of such drop-on-demand type ink jet printers, are a Kaiser type disclosed in Japanese Patent Publication No. Sho 53-12138 and a thermal jet type disclosed in Japanese Patent Publication No. Sho 61-59914, for example. However, the former is hard to reduce in size, and the latter is required to have a high heat resistance of ink because the ink undergoes a high temperature. Thus, both types have very severe problems in application.

To solve the above problems, there has been a newly proposed shear mode type disclosed in U.S. Pat. No. 4,887,100, for example.

FIG. 16 shows a shear mode type ink jet apparatus 1 in the prior art. As shown in FIG. 16, the ink jet apparatus 1 is constructed of a piezoelectric ceramics plate 2, a cover plate 10, a nozzle plate 14, and a substrate 41.

The piezoelectric ceramics plate 2 is provided with a plurality of grooves 3 by grinding with use of a diamond blade or the like. Accordingly, a plurality of side walls 6 extend along the grooves 3 in such a manner that each side wall 6 is formed between adjacent ones of the grooves 3. Each side wall 6 is polarized in a direction indicated by an arrow 5. All the grooves 3 have the same depth, and they are parallel to each other. The depth of each groove 3 is gradually reduced as it approaches a rear end surface 15 of the piezoelectric ceramics plate 2 to form a shallow groove 7 near the rear end surface 15. A pair of metal electrodes 8 are formed on opposed side surfaces of each groove 3 at an upper half portion thereof by sputtering or the like. Further, a metal electrode 9 is formed on opposed side surfaces and a bottom surface of each shallow groove 7 by sputtering or the like. The pair of metal electrodes 8 formed on the opposed side surfaces of each groove 3 are connected with the metal electrode 9 formed on the opposed side surfaces and the bottom surface of the corresponding shallow groove 7 contiguous to the groove 3.

The cover plate 10 is formed of a ceramics material, a resin material, etc. The cover plate 10 is provided with an ink inlet hole 16 and a manifold 18 communicating with the ink inlet hole 16 by grinding, cutting, etc. The lower surface of the cover plate 10, on which the manifold 18 is formed, is bonded to the upper surface of the piezoelectric ceramics plate 2 on which the grooves 3 are formed by an epoxy adhesive 20 (see FIG. 18). Accordingly, a plurality of individual ink chambers 4 functioning as ink channels (see FIG. 18) are defined by the grooves 3 of the piezoelectric ceramics plate 2 and the lower surface of the cover plate 10 to be transversely equally spaced from each other. As shown in FIG. 18, each ink chamber 4 is rectangular in vertical section, and it is filled with ink in operation.

As shown in FIG. 16, the nozzle plate 14 is bonded to the front end surface of the assembly of the piezoelectric ceramics plate 2 and the cover plate 10. The nozzle plate 14 is provided with a plurality of nozzles 12 at laterally spaced positions corresponding to the front end positions of the ink chambers 4. The nozzle plate 14 is formed of a plastic material such as polyalkylene terephthalate (e.g., polyethylene terephthalate), polyimide, polyetherimide, polyetherketone, polyethersulfone, polycarbonate, or cellulose acetate.

The substrate 41 is bonded to the lower surface of the piezoelectric ceramics plate 2 on the opposite side of the cover plate 10 by an adhesive such as an epoxy adhesive. A plurality of individual conductor film patterns 42 are formed on the substrate 41 at transversely spaced positions corresponding to the rear end positions of the ink chambers 4. Each conductor film pattern 42 is connected through a conductor wire 43 to the metal electrode 9 formed on the bottom surface of the shallow groove 7 in the corresponding ink chamber 4 by wire bonding.

FIG. 17 shows a schematic diagram of a control section for controlling the ink jet apparatus 1. As shown in FIG. 17, the conductor film patterns 42 formed on the substrate 41 are individually connected to an LSI chip 51. Also connected to the LSI chip 51 are a clock line 52, a data line 53, a voltage line 54, and a ground line 55. The LSI chip 51 determines from which nozzle 12 the ink droplets are to be jetted according to data appearing on the data line 53 on the basis of continuous clock pulses supplied from the clock line 52. Then, according to the result of determination, the LSI chip 51 applies a voltage V of the voltage line 54 to the conductor film pattern 42 connected to the metal electrode 8 in the ink chamber 4 to be driven. Further, the LSI chip 51 applies a zero volt of the ground line 55 to the other conductor film patterns 42 connected to the metal electrodes 8 in the other ink chambers 4 not to be driven.

The operation of the ink jet apparatus 1 is described with reference to FIGS. 18 and 19. When the LSI chip 51 determines that the ink droplets are to be jetted from the nozzle 12 corresponding to the ink chamber **4*b* as one of the ink chambers 4 of the ink jet apparatus 1 according to given data, a positive driving voltage V is applied to the metal electrodes 8*e* and 8*f* and the metal electrodes 8*d* and 8*g* are grounded. As shown in FIG. 19, a driving electric field in a direction indicated by an arrow 13*b* is generated in the side wall 6*b*, and a driving electric field in a direction indicated by an arrow 13*c* is generated in the side wall 6*c*. As the directions indicated by the arrows 13*b* and 13*c* of the driving electric fields are perpendicular to the direction indicated by the arrow 5 of polarization of the piezoelectric ceramics plate 2, the side walls 6*b* and 6*c* are rapidly deformed inwardly of the ink chamber 4*b* by a piezoelectric thickness shear effect. This deformation of the side walls 6*b* and 6*c* reduces the volume of the ink chamber 4*b* to rapidly increase the pressure of the ink filled in the ink chamber 4*b* and thereby generate a pressure wave. As a result, the ink droplets are jetted from the nozzle 12 (see FIG. 19) communicating with the ink chamber 4*b***.

When the application of the driving voltage V is stopped, the side walls **6*b* and 6*c* gradually restore their original positions before deformation (see FIG. 18), and the pressure of the ink contained in the ink chamber 4*b* is therefore gradually decreased. Then, additional ink is supplied from an ink tank (not shown) through the ink inlet hole 16 (see FIG. 16) and the manifold 18 (see FIG. 16) into the ink chamber 4***b*.

Referring to FIG. 14 for explanatory purposes, which is a sectional side view of the ink jet apparatus according to the invention, when the pressure in each ink chamber 4 is increased to jet the ink droplets, the ink is forced from the corresponding nozzle 12 simultaneously, the ink reversely flows from the manifold 18 into the ink inlet hole 15. As a result, the pressure near the manifold 18 is rapidly reduced to generate a negative pressure wave. When this negative pressure wave reaches the nozzle 12, the ink jet from the nozzle 12 is stopped. The shorter the distance y between the front side surface of the manifold 18 and the inner surface of the nozzle plate 14, the shorter the time of reach of the negative pressure wave to the nozzle 12. Accordingly, when the distance y is reduced, the ink jet from the nozzle 12 is quickly stopped to result in a reduction in volume of ink droplets, causing a deterioration in print quality. On the other hand, when the distance y is largely increased, to cope with the above problem, the distance x between the front side surface of the manifold 18 and the rear end surface of each ink chamber 4 becomes very small. Accordingly, the ink flow from the manifold 18 into each ink chamber 4 becomes difficult, so that a necessary amount of ink cannot be supplied to each ink chamber 4. As a result, the volume of ink droplets is reduced to cause deterioration in print quality.

SUMMARY OF THE INVENTION

It is a primary object of the present invention to provide an ink jet apparatus that can maintain a pressure necessary for jetting ink droplets for a relatively long period of time and can smoothly introduce ink from the manifold into each ink chamber, thereby improving a print quality.

According to the present invention, an ink jet apparatus includes a plurality of ink chambers each having a front end and a rear end. A manifold is provided to introduce ink into each of the ink chambers and has a front side surface on a side near the front end of the each ink chamber. A nozzle is provided at the front end of each ink chamber. The ink is jetted from the nozzle by applying a pressure to the ink contained in each ink chamber. The improvement of this invention is that a position of the manifold is such that a distance between the front side surface of the manifold and the rear end of the each ink chamber is set to 0.2 mm or more, and a distance between the front side surface of the manifold and the nozzle is set to 3 mm or more.

Preferably, the distance between the front side surface of the manifold and the nozzle comprises a distance between the front side surface of the manifold and an opening of the nozzle on a side exposed to the ink chamber.

In the ink jet apparatus of the present invention having the above construction, pressure necessary for jetting ink droplets can be maintained for a relatively long period of time. A flow resistance to the ink flowing from the manifold into each ink chamber can be reduced.

As described above, the distance between the front side surface of the manifold and the nozzle is set so that the pressure near the nozzle can be maintained for a necessary period of time upon jetting of the ink, thereby ensuring a sufficient volume of ink droplets to be jetted. Accordingly, print quality is improved. Further, since a necessary amount of ink is supplied to each ink chamber, the volume of ink droplets to be jetted can be made into a desired value, thereby improving print quality.

Other objects and features of the invention will be more fully understood from the following detailed description and appended claims when taken with the accompanying drawings.

BRIEF DESCRIPTION OF THE DRAWINGS

FIG. 13 is a table showing the result of an endurance test when various materials are used for the piezoelectric ceramics plate and the cover plate of the ink jet apparatus;

DETAILED DESCRIPTION OF PREFERRED EMBODIMENTS

Figure 1A:
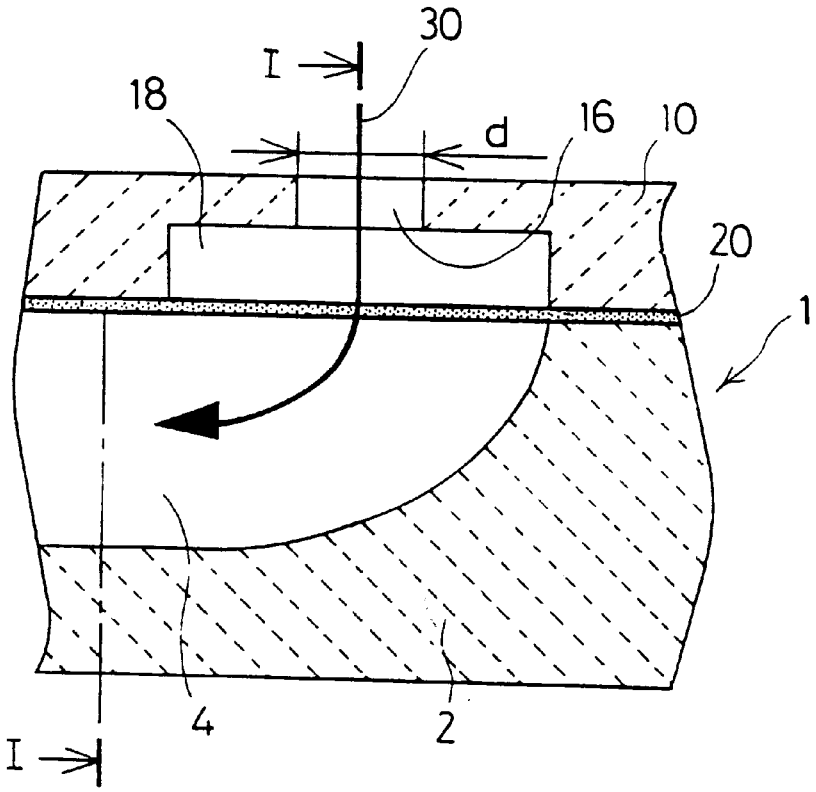
FIG. 1A is an enlarged partial sectional view of a principle part of an ink jet apparatus in a preferred embodiment according to the present invention, showing the size of an ink inlet hole.

A preferred embodiment of the present invention is described referring to the drawings, in which the same members as those shown in FIGS. 16 to 19 are denoted by the same reference numerals, and the explanation thereof will be omitted.

Figure 1B:
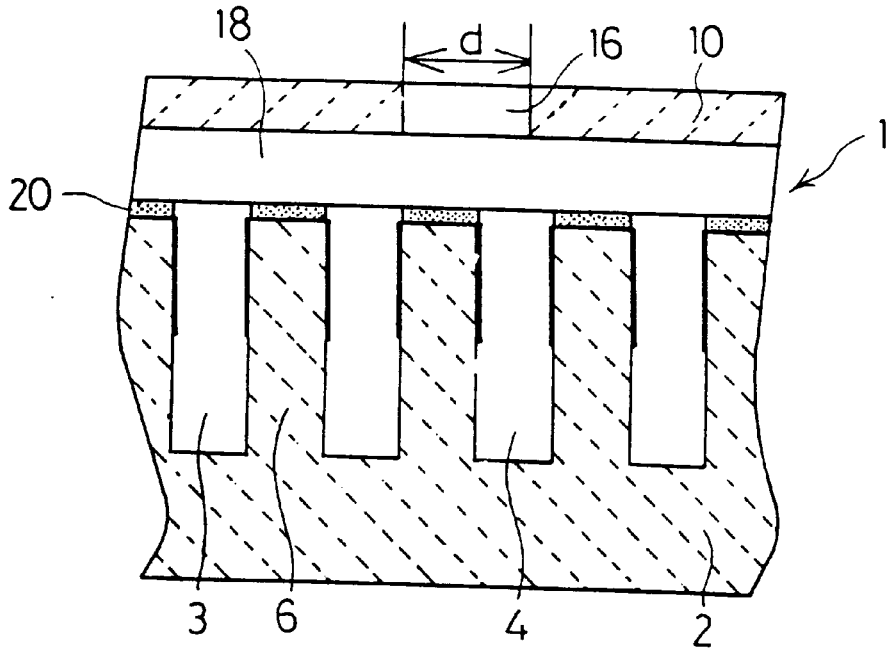
FIG. 1B is a partial cross section taken along the line I—I in FIG. 1A.

FIGS. 1A and 1B are enlarged views of an ink inlet hole 16 and a manifold 18 in the preferred embodiment. Specifically, FIG. 1A is a cross section taken from the side of an ink jet apparatus 1, and FIG. 1B is a cross section taken along the line I—I in FIG. 1A.

As shown in FIG. 1B, the ink jet apparatus 1 includes a piezoelectric ceramics plate 2 and a cover plate 10. The piezoelectric ceramics plate 2 has a plurality of grooves 3 and a plurality of side walls 6 partitioning the grooves 3. The cover plate 10 has the ink inlet hole 16 and the manifold 18. The piezoelectric ceramics plate 2 and the cover plate 10 are bonded together by an adhesive 20 to thereby define a plurality of ink chambers 4 as ink channels.

As shown by an arrow 30 in FIG. 1A, ink is supplied from an ink tank (not shown) through an ink supply tube (not shown) into the ink inlet hole 16 having a diameter d. Then, the ink is supplied from the ink inlet hole 16 through the manifold 18 into each ink chamber 4. Since the manifold 18 has a sectional area larger than that of the ink inlet hole 16 as shown, the ink flowing from the ink inlet hole 16 into the manifold 18 is jetted therein. Accordingly, the ink undergoes a divergent flow loss due to rapid enlargement of a channel. A total flow loss occurring in the ink flowing from the ink inlet hole 16 into the manifold 18 varies according to the state the ink is jetted in. When the ink is jetted in a state of laminar flow, the total flow loss is equal to the divergent flow loss. When the ink is jetted in a state of turbulent flow, the total flow loss is equal to the sum of the divergent flow loss and a turbulent flow loss.

To reduce the total flow loss and obtain a stable flow of the ink, excluding any small fluctuations, the jet state must be kept in the laminar flow state. To obtain the laminar flow state, it is known that a Reynolds number Re, which is an important parameter deciding the flow state of a fluid, must be reduced to about 30 or less (see for example, *Dynamics of Viscous Fluid*, Takefumi Ikui and Masahiro Inoue, p. 206, Rikogaku-sha). The Reynolds number Re is expressed as $Re=ud/\nu$, where u represents the velocity of the ink flowing from the ink inlet hole 16; d represents the diameter of the ink inlet hole 16; and $\nu$ represents the coefficient of kinematic viscosity of the ink. If the consumption of the ink per unit time is fixed, the velocity u is in inverse proportion to the square of the diameter d of the ink inlet hole 16. The Reynolds number Re is, therefore, in inverse proportion to the diameter d of the ink inlet hole 16, as shown in FIG. 2.

In this preferred embodiment, the maximum consumption of the ink per unit time was set so that ink droplets in a volume of 40 pl were simultaneously jetted from 25 nozzles at a frequency of 5 kHz. A value of 10 cps of pigment ink containing tripropylene glycol monomethylether (TPM) as a base at ordinary temperature was used as the coefficient of kinematic viscosity $\nu$ of the ink. Then, the diameter d of the ink inlet hole 16 was varied to obtain the Reynolds number Re. The relation shown by a solid curve 32 in FIG. 2 was obtained as the result.

The Reynolds number Re is influenced not only by the diameter d of the ink inlet hole 16 but also by the consumption of the ink per unit time and the coefficient of kinematic viscosity $\nu$ of the ink. The consumption of the ink per unit time cannot be reduced because a printing speed and clearness must be maintained. The coefficient of kinematic viscosity $\nu$ of the ink cannot be largely increased due to the need for stability of the jet of ink droplets. In particular, it is desired to prevent generation of unduly small ink droplets called satellites. Accordingly, there is a possibility that the relation between the Reynolds number Re and the diameter d of the ink inlet hole 16 may shift upwards as shown by a broken line 34 in FIG. 2 according to a change in printing speed or ink viscosity. However, there is no possibility that the relation may shift downwards from the solid line 32 calculated by using a minimum printing speed and a minimum ink viscosity.

Figure 2:
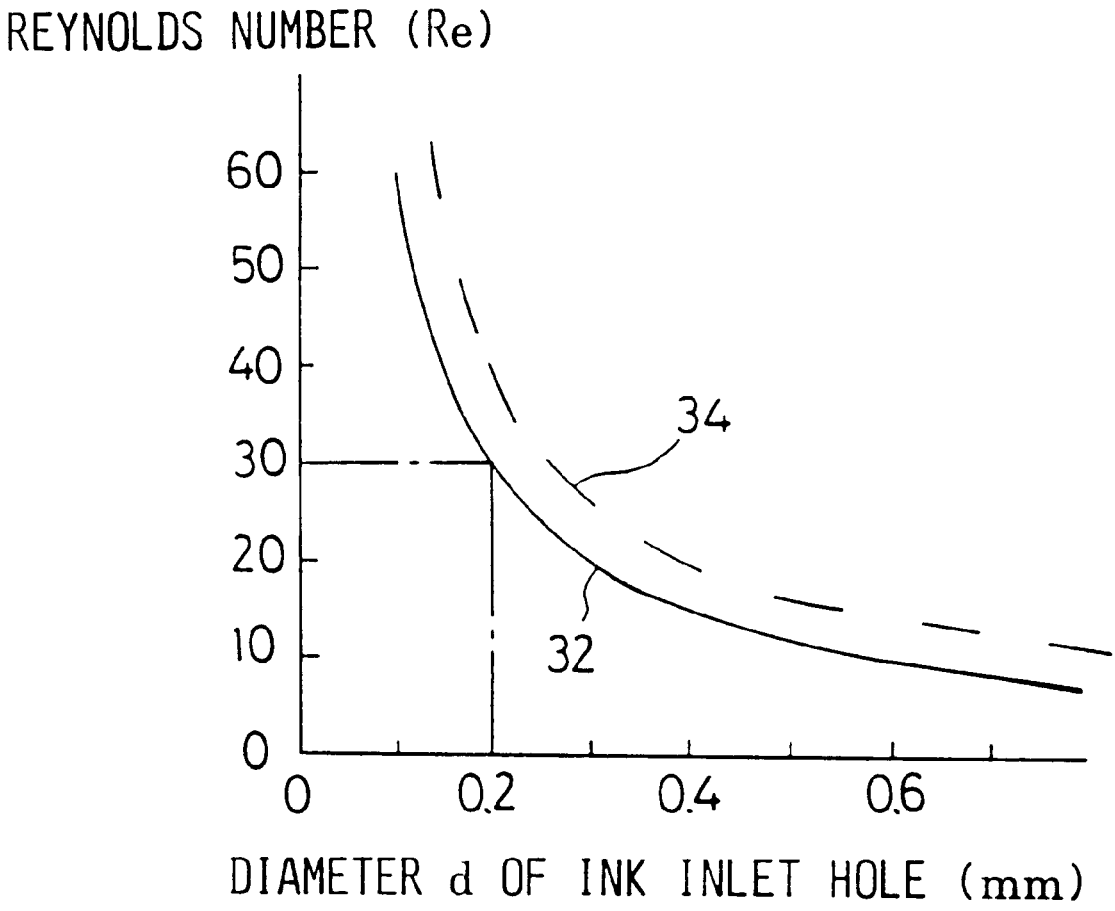
FIG. 2 is a graph showing the relation between the diameter of the ink inlet hole and a Reynolds number.

Using the relation shown by the solid line 32 in FIG. 2, the larger the diameter d of the ink inlet hole 16, the less likely the jet state will become the turbulent flow state. As is apparent from FIG. 2, the diameter d of the ink inlet hole 16 must be set to 0.2 mm or more to reduce the Reynolds number Re to 30 or less.

As mentioned above, the jet state of the ink flowing from the ink inlet hole 16 into the manifold 18 can be made into a laminar flow state by setting the diameter d of the ink inlet hole 16 to 0.2 mm or more. Accordingly, the total flow loss occurring in the ink flowing from the ink inlet hole 16 into the manifold 18 becomes the divergent flow loss, so that the total flow loss can be minimized, resulting in no turbulence of the ink flow in the manifold 18. Accordingly, the pressure of the ink in the manifold 18 becomes constant, and the pressure of the ink in each ink chamber 4 therefore becomes constant. As a result, the volume and the flying speed of ink droplets to be jetted become constant, thereby improving print quality. Further, since a desired amount of ink is supplied to each ink chamber 4, the volume of ink droplets to be jetted becomes a desired amount, thereby improving a print quality.

In this preferred embodiment, the size of the ink inlet hole 16 having a circular shape is decided to reduce the Reynolds number Re to 30 or less. When the ink inlet hole 16 is rectangular, elliptical, etc., the Reynolds number Re that will not cause a turbulent flow of ink may be obtained by carrying out a test to decide the size of the ink inlet hole 16.

In the ink jet apparatus 1 of this preferred embodiment, the ratio of pressure generated in each ink chamber 4 to driving voltage applied to each electrode 8 is large. Further, the ink flow into each ink chamber 4 is stable, and a resistance to the ink flow is small. Accordingly, a high pressure can be generated in each ink chamber 4 by applying a low driving voltage, and ink droplets can be jetted with a speed and a volume sufficient to form print images. According to the ink jet apparatus 1 of this preferred embodiment, ink droplets can be stably jetted with a speed of about 3 to 8 m/sec and a volume of about 30 to 90 pl by applying a low driving voltage of about 20 to 50 volts. Thus, a driving circuit can be manufactured at a low cost with a small size. The ink jet apparatus 1 as a whole can therefore be manufactured at a low cost with a small size.

Figure 3A:
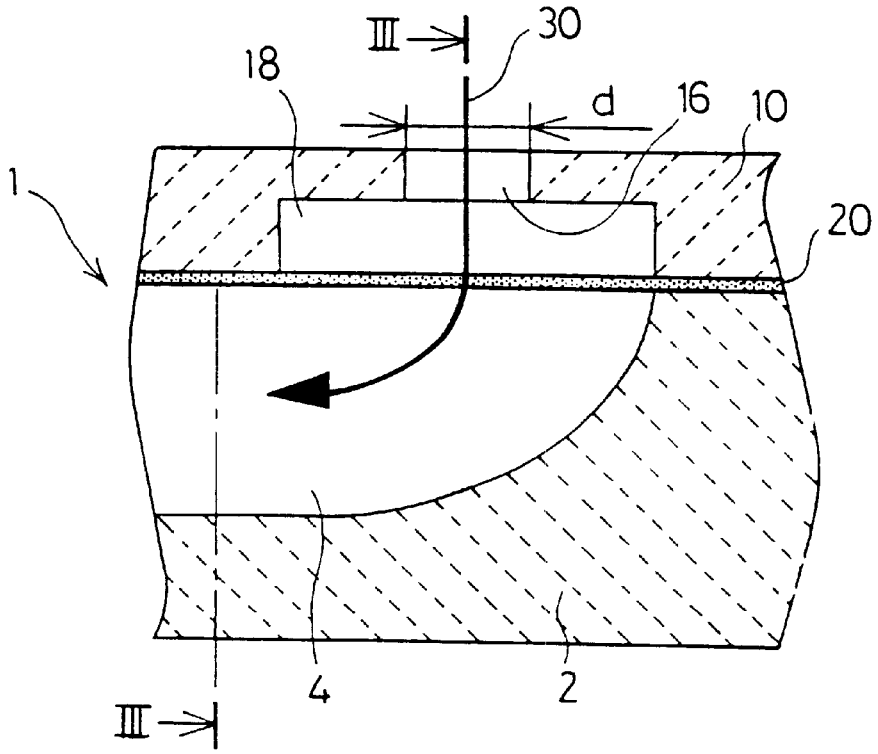
FIG. 3A is an enlarged partial sectional view similar to FIG. 1A, showing the depth of a manifold.
Figure 3B:
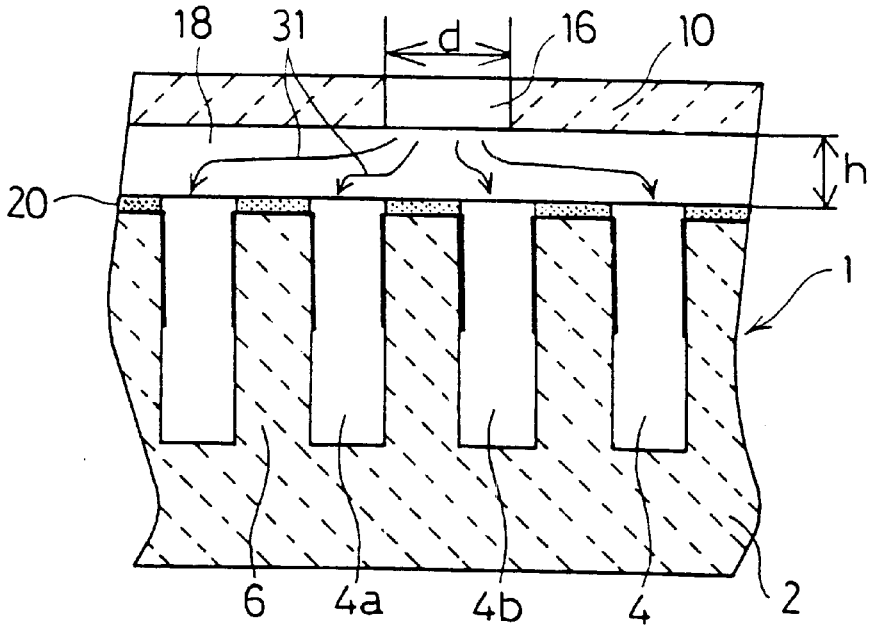
FIG. 3B is a partial cross section taken along the line III—III in FIG. 3A.

Now, the depth of the manifold 18 is described referring to FIG. 3*a*. As shown by an arrow 30 in FIG. 3*a*, ink is supplied from an ink tank (not shown) through an ink supply tube (not shown) into the ink inlet hole 16. Then, the ink is supplied from the ink inlet hole 16 through the manifold 18 into each ink chamber 4. At this time, the ink in the manifold 18 flows, as shown by arrows 31 in FIG. 3B, into each ink chamber 4. Since ink chambers 4*a* and 4*b* directly face the ink inlet hole 16, the ink pressures in the ink chambers 4*a* and 4*b* are changed by the jet of the ink flowing from the ink inlet hole 16.

Figure 4:
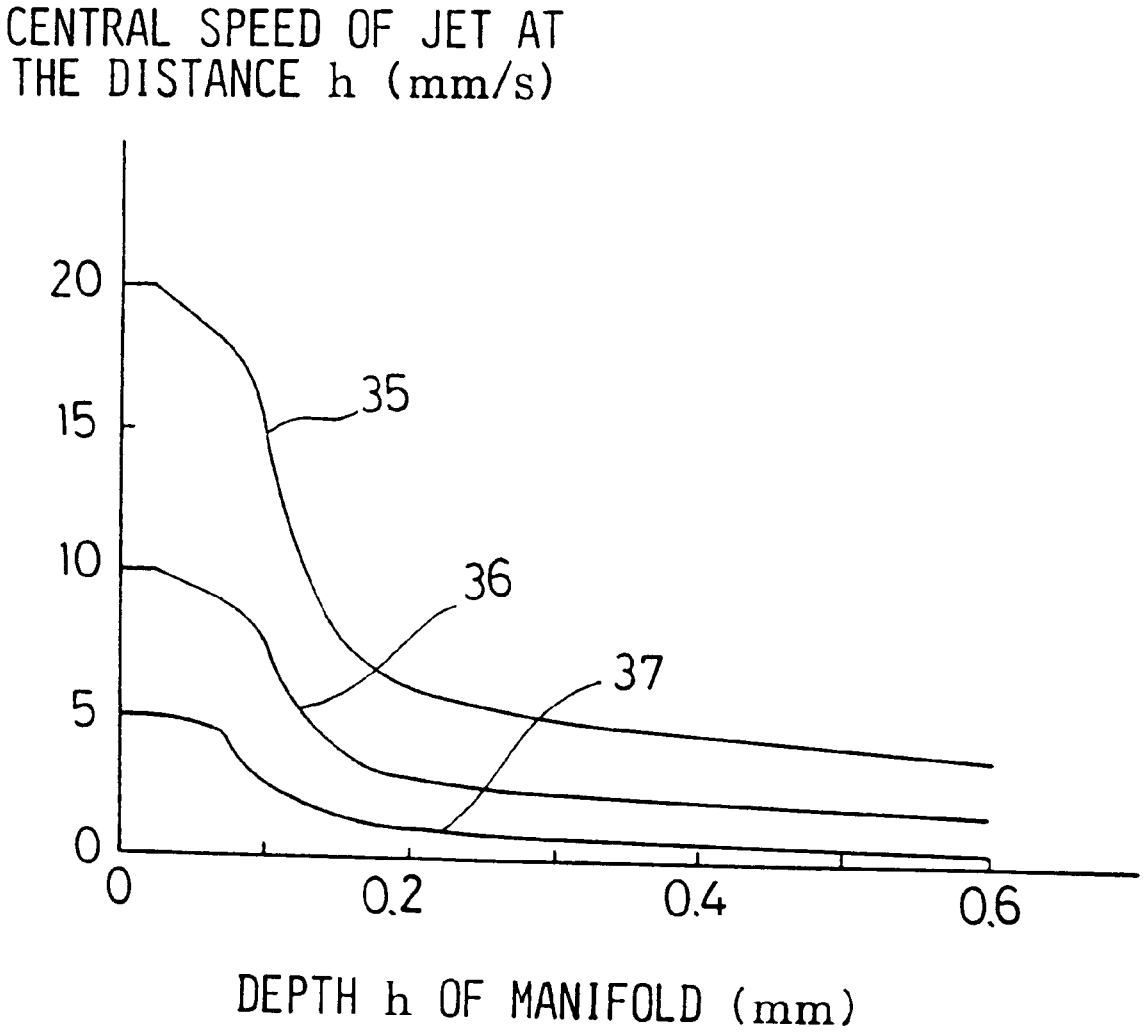
FIG. 4 is a graph showing the relation between the depth of the manifold and the central speed of a jet.

FIG. 4 shows a change in central speed of the ink jet when the ink flows from the ink inlet hole 16 through the manifold 18 into the ink chambers 4*a* and 4*b* directly facing the ink inlet hole 16. In FIG. 4, the axis of the abscissa represents the depth h of the manifold 18, and the axis of the ordinate represents the central speed of the jet. In this preferred embodiment, a test was carried out using three values of the diameter d of the ink inlet hole 16 and setting a maximum ink consumption so that ink droplets in a volume of 40 pl were simultaneously jetted from 20 nozzles at a frequency of 5 kHz. Solid lines 35, 36, and 37 shown in FIG. 4 correspond to the diameter d of the ink inlet hole 16 set to 0.7, 1.0, and 1.4 mm, respectively.

As is apparent from FIG. 4, when the depth h of the manifold 18 is zero, the central speed u of the ink jet flowing from the ink inlet hole 16 is maximum in each case. As well known, the central speed u of the ink jet is in inverse proportion to the square of the diameter d of the ink inlet hole 16. The central speed u relatively rapidly decreases with an increase in depth h from zero. When the depth h becomes about 0.2 mm or more, especially, 0.3 mm or more, the central speed u becomes sufficiently small in each case. Even when the depth h is further increased, the central speed u hardly decreases in each case. Further, as far as the diameter d of the ink inlet hole 16 is 0.2 mm or more, a tendency similar to that shown in FIG. 4 is exhibited.

The flow velocity of the jet is proportional to the ink consumption per unit time, which varies according to a print pattern. Accordingly, unless the depth h of the manifold 18 is set to a value enough to diminish the influence of the ink jet flowing from the ink inlet hole 16, the ink pressures in the ink chambers 4*a* and 4*b* directly facing the ink inlet hole 16 would vary according to the print pattern, causing instability of jetting of the ink droplets.

Consequently, in the ink jet apparatus 1 of this preferred embodiment, the depth h of the manifold 18 for distributing the ink flowing from the inlet hole 16 to each ink chamber 4 is set to 0.2 mm or more, preferably 0.3 mm or more.

Because the depth h of the manifold 18 is set to 0.2 mm or more, preferably 0.3 mm or more, the ink flow into each ink chamber becomes stable and uniform. Accordingly, the pressure generated in each ink chamber 4 upon application of a driving voltage to each electrode 8 becomes constant, and ink droplets can be jetted with a speed and a volume sufficient to form print images. According to the ink jet apparatus 1 of this preferred embodiment, ink droplets can be stably and uniformly jetted with a speed of about 3 to 8 m/sec and a volume of about 30 to 90 pl by applying a driving voltage of about 20 to 50 volts. Further, since the ink flow into each ink chamber 4 is stable and uniform, it is not necessary to provide a function for correcting the ink flow in the driving circuit. Thus, the driving circuit can be simplified and made compact. The ink jet apparatus 1 can therefore be stabilized and manufactured at a low cost with a small size.

Figure 5A:
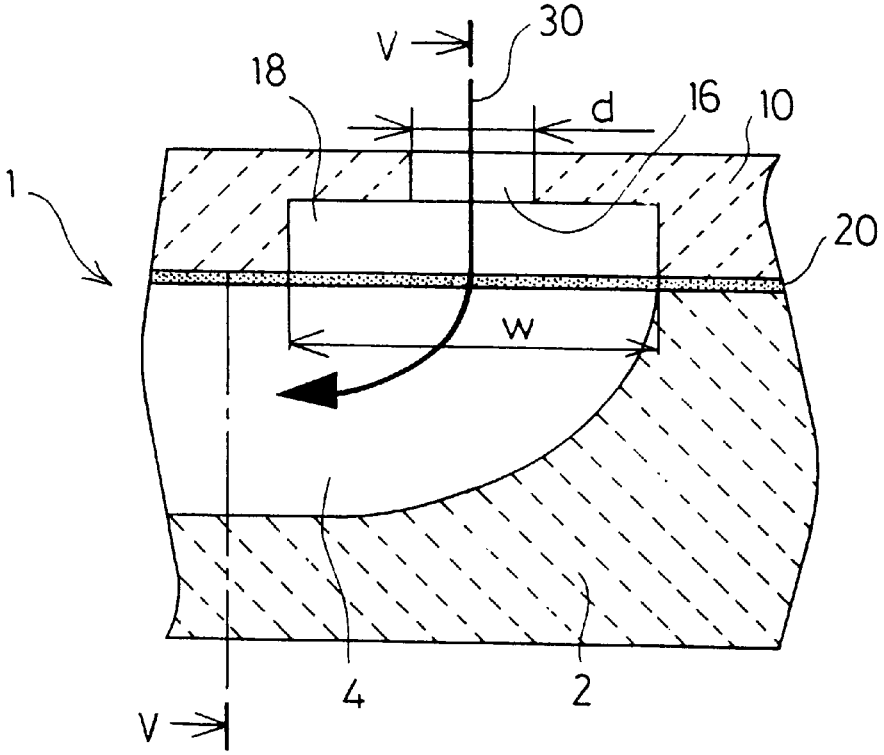
FIG. 5A is a view similar to FIG. 1A, showing the sectional area of the manifold and the total sectional area of ink chambers.

The relation between the sectional area of the manifold 18 and the total sectional area of the ink chambers 4 is described referring to FIG. 5A. In this description, the sectional area of the manifold 18 means the area of a cross section perpendicular to the longitudinal direction of the manifold 18, and the total sectional area of the ink chambers 4 means the total areas of the cross sections perpendicular to the longitudinal directions of all of the ink chambers 4.

As shown by an arrow 30 in FIG. 5A, ink is supplied from an ink tank (not shown) through an ink supply tube (not shown) into the ink inlet hole 16. Then, the ink is supplied from the ink inlet hole 16 through the manifold 18 into each ink chamber 4. At this time, the ink in the manifold 18 flows as shown by arrows 31 in FIG. 5B into each ink chamber 4.

Figure 6:
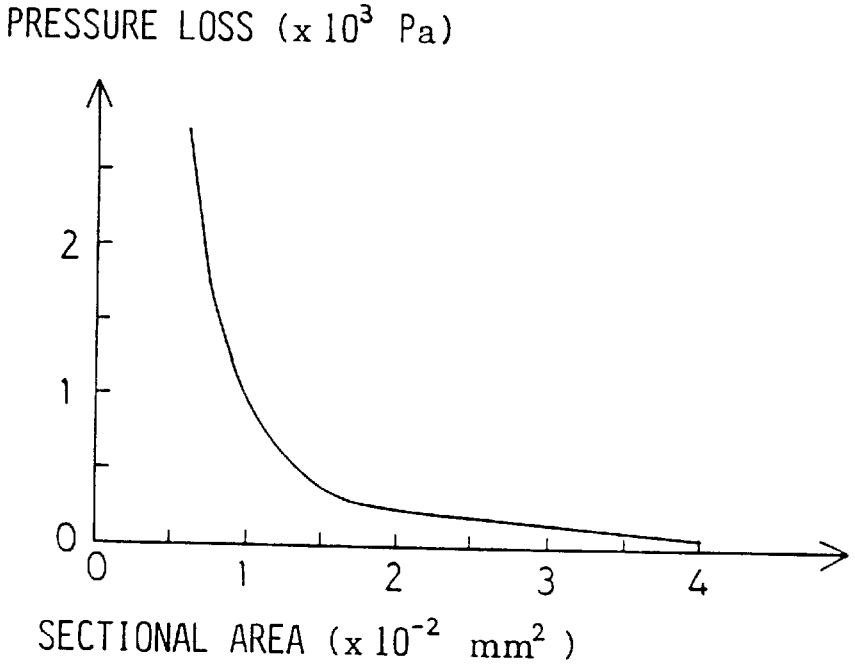
FIG. 6 is a graph showing the relation between the sectional area of a channel and a pressure loss.

The manifold 18 is a rectangular channel having a sectional area S1=w×h as shown. Each ink chamber 4 is a rectangular channel having a sectional area S2=b×H as shown. When the ink flows in these channels, it undergoes a flow resistance. In general, a flow resistance increases proportionally to the length of a channel and rapidly decreases with a decrease in sectional area of the channel. When the channel has a rectangular cross section as in the manifold 18 and each ink chamber 4, the flow resistance to the ink in a unit length of the channel is in substantially inverse proportion to the square of the sectional area of the channel, as shown in FIG. 6. This is true provided that the aspect ratio of the channel is kept substantially constant when the cross section of the channel changes in size. However, when the height and the width of the rectangular cross section are greatly different from each other, the relation shown in FIG. 6 is not obtained. Assuming that the height and the width of the rectangular cross section in both the manifold 18 and each ink chamber 4 are not greatly different from each other, the relation between the sectional area of the cross section and the flow resistance in both the manifold 18 and each ink chamber 4 shows a tendency similar to that shown in FIG. 6.

Figure 5B:
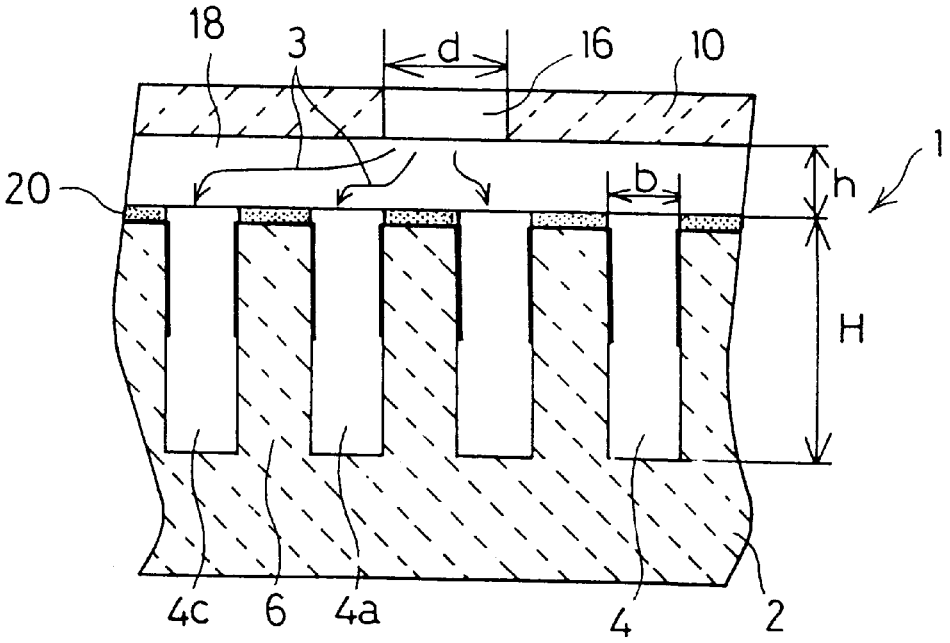
FIG. 5B is a cross section taken along the line V—V in FIG. 5A.

The ink flowing from the ink inlet hole 16 undergoes a flow, resistance in the manifold 18 and a flow resistance in each ink chamber 4 until the ink reaches each nozzle (not shown). In other words, the total flow resistance to the ink is the sum of the flow resistance in the manifold 18 and the flow resistance in all of the ink chambers 4. As shown in FIG. 5B, a flow distance from the ink inlet hole 16 to an ink chamber 4*c* is larger than a flow distance from the ink inlet hole 16 to an ink chamber 4*a*, for example. Therefore, the flow resistance to the ink that will flow into the ink chamber 4*c* becomes larger than the flow resistance to the ink that will flow into the ink chamber 4*a*. Further, the ink that will flow into another ink chamber 4 more distant from the ink inlet hole 16 than the ink chamber 4*c* undergoes a larger flow resistance.

To make the ink flow into each ink chamber 4 uniform, the manifold 18 is designed in such a manner that the flow resistance in the manifold 18 becomes uniform regardless of the position of each ink chamber 4. Alternatively, the manifold 18 is designed to have a sectional area such that the flow resistance in the manifold 18 is insignificant compared with the flow resistance in each ink chamber 4. The former method is impractical in general because the shape and the forming of the manifold 18 are complicated. Accordingly, the latter method will now be described.

Figure 7:
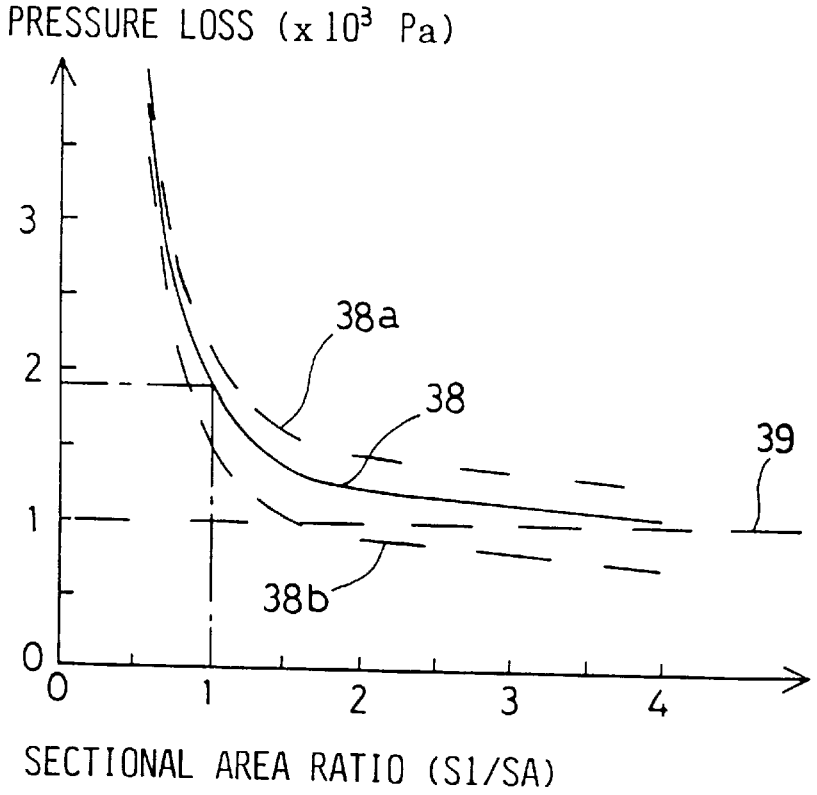
FIG. 7 is a graph showing the relation between the ratio of the sectional area of the manifold to the total sectional area of the ink chambers and a pressure loss.

FIG. 7 shows a change in total flow resistance to the ink in this preferred embodiment, in which the axis of abscissa represents a sectional area ratio S1/SA between the manifold 18 and all the ink chambers 4. The sectional area SA of all of the ink chambers 4 is equal to the product of the sectional area S2 of each ink chamber 4 and the number of all of the ink chambers 4. In a test according to this preferred embodiment, the maximum ink consumption per unit time was set so that ink droplets in a volume of 40 pl were simultaneously jetted from 50 nozzles at a frequency of 2.5 kHz. A value of 10 cps of pigment ink containing tripropylene glycol monomethylether (TPM) as a base at ordinary temperature was used as the coefficient of kinematic viscosity ν of the ink. The dimensions of each ink chamber 4 were the height H of 400 μm, the width b of 80 μm, and the length of 12 mm.

In FIG. 7, a solid line 38 is a curve showing the total flow resistance to the ink, and a broken line 39 is a line showing the flow resistance in the ink chambers 4 only with no flow resistance in the manifold 18. As is apparent from FIG. 7, the total flow resistance rapidly increases on the left side of the sectional area ratio S1/SA with respect to a boundary value of about 1, that is, it rapidly increases with a decrease in sectional area ratio S1/SA from about 1. Further, when the sectional area ratio S1/SA increases from about 1, the total flow resistance rapidly approaches the flow resistance in the ink chambers 4 only as shown by the broken line 39. In other words, when the sectional area ratio S1/SA decreases from 1, the flow resistance in the manifold 18 rapidly increases; while, when the sectional area S1/SA increases from 1, the flow resistance in the manifold 18 rapidly decreases.

Accordingly, the sectional area ratio S1/SA needs to be set to 1 or more to reduce the flow resistance in the manifold 18. Further, in an ink jet apparatus having a structure like that of this preferred embodiment, there is no possibility that the inks in the adjacent ink chambers 4 will be simultaneously jetted. Accordingly, the total sectional area of all of the ink chambers 4 becomes half in reality. Even considering this fact, the sectional area ratio S1/SA needs to be set to 0.5 or more.

Thus, the increase in the sectional area ratio S1/SA is necessary for a reduction in flow resistance in the manifold 18. However, when the sectional area ratio S1/SA becomes about 5 or more, the flow resistance in the manifold 18 is greatly reduced to 1% or less of the flow resistance in the ink chambers 4, which is substantially insignificant. Accordingly, an increase in sectional area ratio S1/SA from about 5 merely causes enlargement of the ink jet apparatus 1 and is hardly effective for the reduction in the total flow resistance. Thus, it is reasonable to set the sectional area ratio S1/SA to a value up to 5 from the viewpoints of a reduction in size and cost of the ink jet apparatus 1.

In the test according to this preferred embodiment, the dimensions of each ink chamber 4 were set to 400 μm in height H, 80 μm in width b, and 12 mm in length. However, even when the dimensions of each ink chamber 4 are changed, the above preferable sectional area ratio S1/SA is unchanged. That is, as shown in FIG. 7, the curve 38 showing a pressure loss is merely expanded or contracted in a vertical direction on the basis of the axis of abscissa as shown by a broken line 38*a* or 38*b*.

Consequently, in the ink jet apparatus 1 of this preferred embodiment, the sectional area of the manifold 18 for distributing the ink having flowed from the ink inlet hole 16 into each ink chamber 4 is set to about 0.5 to 5 times the total sectional area of all of the ink chambers 4.

Because the sectional area of the manifold 18 is set to about 0.5 to 5 times the total sectional area of all the ink chambers 4, the ink is substantially uniformly distributed through the manifold 18 into each ink chamber 4 with a low flow resistance. Accordingly, the ink can be smoothly introduced into each ink chamber 4, and a high pressure can be generated in each ink chamber 4 by applying a low driving voltage. Thus, ink droplets are jetted with a sufficient speed and a uniform volume to form print images. According to the ink jet apparatus 1 of this preferred embodiment, ink droplets can be stably jetted with a speed of about 3 to 8 m/sec and a volume of about 30 to 90 pl by applying a low driving voltage of about 20 to 50 volts. Thus, a driving circuit can be manufactured at a low cost with a small size. The ink jet apparatus 1 as a whole can therefore be manufactured at a low cost with a small size.

Figure 8:
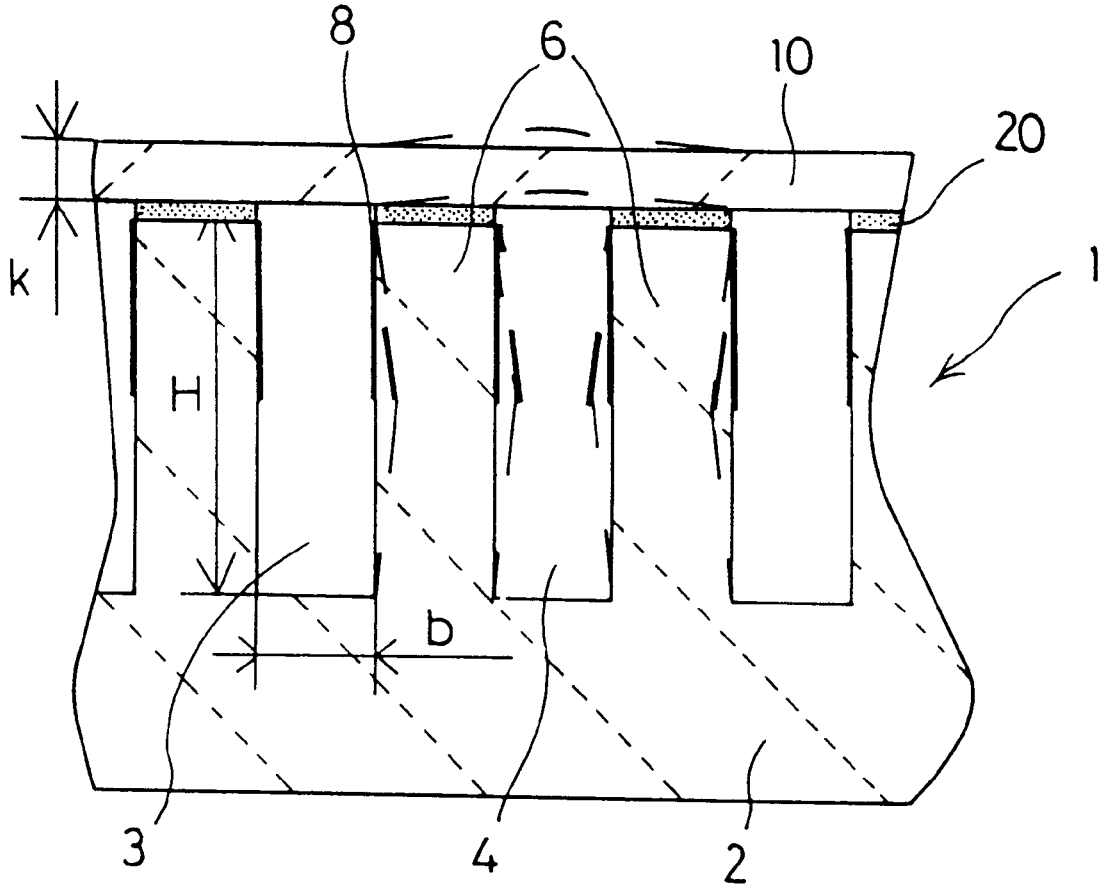
FIG. 8 is a schematic partial sectional view similar to FIG. 1B, showing the depth of each ink chamber and the thickness of a cover plate.

Now, the depth of each groove 3 forming each ink chamber 4 and the thickness of the cover plate 10 is described referring to FIG. 8 which is a sectional view of a part of the ink jet apparatus 1 showing the shapes of the grooves 3, the side walls 6, the metal electrodes 8, and the cover plate 10. Reference character b represents the width of each groove 3 formed on the piezoelectric ceramics plate 2, and reference character H represents the depth of each groove 3. As each metal electrode 8 is formed on the upper half portion of each side wall 6, the length from the upper end to the lower end of each metal electrode 8 becomes half of the depth H of each groove 3, that is, becomes H/2. Further, reference character k represents the thickness of the cover plate 10 made of the same material as that of the piezoelectric ceramics plate 2.

The relation between the depth H of each groove 3 forming each ink chamber 4 and the thickness k of the cover plate 10 was examined to obtain a flying speed of ink droplets necessary for stable printing.

In a test according to this preferred embodiment, three kinds of piezoelectric ceramics plates 2 having different groove depths H of 0.2, 0.4, and 0.6 mm were used. In each piezoelectric ceramics plate 2, the width of each side wall 6 was set to 80 μm, and the width b of each groove 3 was set to 80 μm. Lead zirconate titanate (PZT) piezoelectric ceramics were used as the materials of the piezoelectric ceramics plate 2 and the cover plate 10. An aluminum film having a thickness of about 1 μm formed by vacuum deposition was used as each metal electrode 8, and an epoxy adhesive was used as the adhesive 20. Further, four kinds of cover plates 10 having different thicknesses k of 0.25, 0.5, 1, and 2 mm were used. Thus, twelve kinds of ink jet apparatus 1 were totally prepared by using the three kinds of piezoelectric ceramics plate 2 and the four kinds of cover plates 10 in combination. Further, pigment ink containing tripropylene glycol monomethylether (TPM) as a base was used as the ink, and a driving voltage to be applied to each metal electrode 8 was set to 40 volts. The flying speed of ink droplets was calculated by emitting light from a light emitting diode in synchronism with a driving voltage pulse to form a still image of the droplets and shifting a timing of the light emission to the driving voltage pulse to obtain a travel of the still image of the ink droplets.

Figure 9:
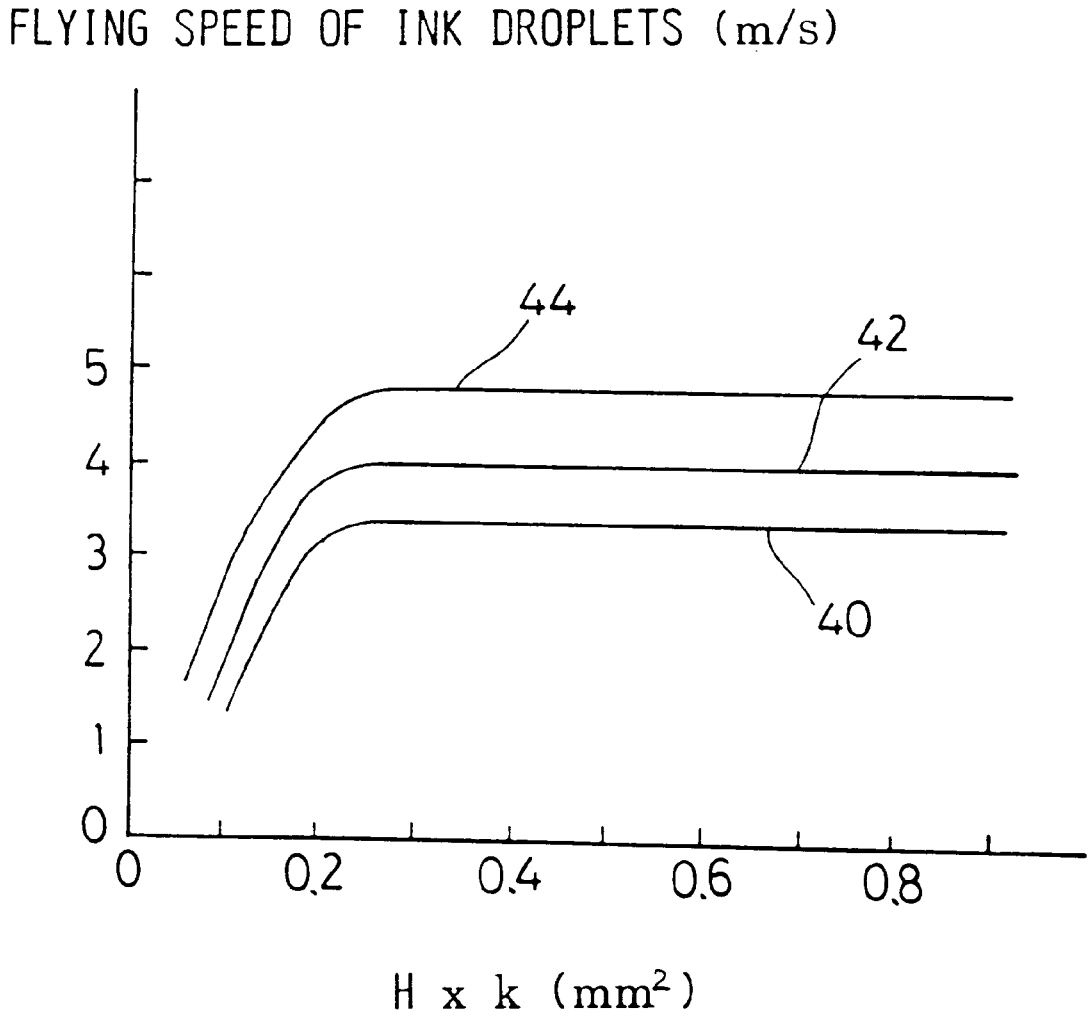
FIG. 9 is a graph showing the relation between the product of the depth of each ink chamber and the thickness of the cover plate and the flying speed of ink droplets.

The flying speeds of ink droplets in the various kinds of ink jet apparatus 1 prepared above were measured. The result of measurement is shown in FIG. 9, in which the axis of abscissa represents the product H×k of the depth H of each groove 3 and the thickness k of the cover plate 10 and the axis of ordinate represents the flying speed of ink droplets. In FIG. 9, solid lines 40, 42, and 44 correspond to the ink jet apparatuses 1 having the depths H of 0.2, 0.4, and 0.6 mm, respectively.

As is apparent from FIG. 9, the larger the depth H of each groove 3, the larger the flying speed of droplets. In each of the solid lines 40, 42, and 44, the flying speed rapidly decreases when the product H×k becomes about 0.2 or less. The reason for such a rapid decrease is that when the adjacent side walls 6 are deformed as shown by broken lines in FIG. 8 at the time of jetting of the ink, the cover plate 10 is minutely deformed as shown by broken lines in FIG. 8. The larger the rate of the deformation of the cover plate 10 to the volume of each ink chamber 4, the smaller the increase in pressure in each ink chamber 4, resulting in a reduction in flying speed of droplets. To reduce the rate of the deformation of the cover plate 10 to the volume of each ink chamber 4, it is necessary to either enlarge the depth H of each groove 3 or enlarge the thickness k of the cover plate 10. Accordingly, it is sufficient to enlarge the product H×k. As is apparent from FIG. 9, it is preferable to set the product H×k to 0.2 or more, so as not to rapidly decrease the flying speed of ink droplets.

While the width of each side wall 6 was set to 80 μm in the above test according to this preferred embodiment, a tendency similar to that shown in FIG. 9 is exhibited even when the width of each side wall 6 varies from the above value.

Further, while the width b of each groove 3 was set to 80 μm in the above test, a tendency similar to that shown in FIG. 9 is exhibited when the width b of each groove 3 is about 80 μm.

Consequently, in the ink jet apparatus 1 according to this preferred embodiment, the product of the depth of each groove 3 and the thickness of the cover plate 10 is set to 0.2 (mm×mm) or more.

Because the product of the depth of each groove 3 and the thickness of the cover plate 10 is set to 0.2 (mm×mm) or more, the deformation of the cover plate 10 due to the deformation of the side walls 6 can be prevented as much as possible. Accordingly, the ratio of the pressure generated in each ink chamber 4 to the driving voltage to be applied to each metal electrode 8 can be increased. Accordingly, a high pressure can be generated in each ink chamber 4 by applying a low driving voltage, and ink droplets can be jetted with a speed and a volume enough to form print images. According to the ink jet apparatus 1 of this preferred embodiment, ink droplets can be jetted with a speed of about 3 to 8 m/sec and a volume of about 30 to 90 pl by applying a low driving voltage of about 20 to 50 volts. Thus, a driving circuit can be manufactured at a low cost with a small size. The ink jet apparatus 1 as a whole can therefore be manufactured at a low cost with a small size.

Figure 10A:
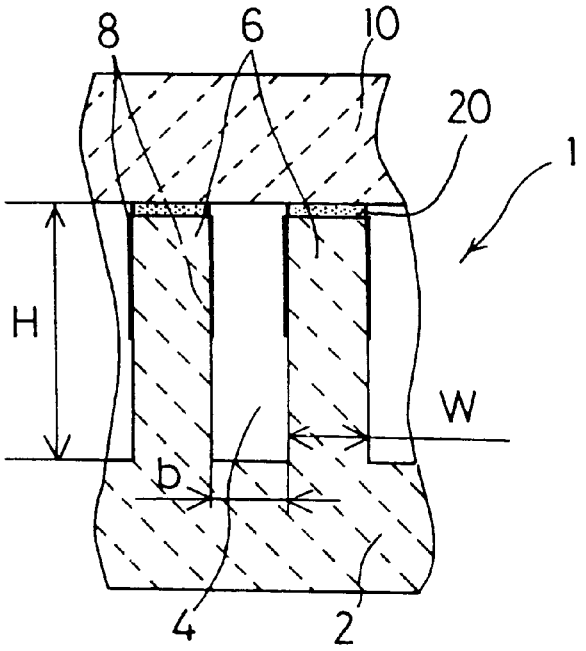
FIG. 10A is a partial sectional view similar to FIG. 1B, showing when the bonded surface of the cover plate is smooth.
Figure 10B:
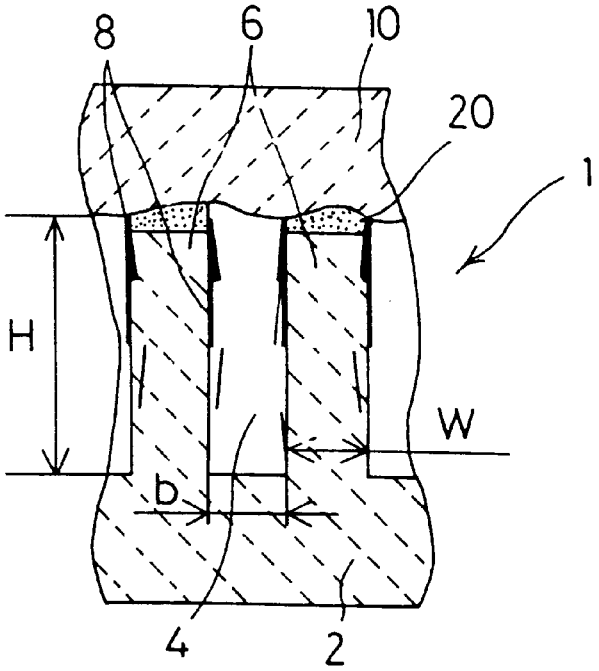
FIG. 10B is a partial sectional view similar to FIG. 10A, showing when the bonded surface of the cover plate is rough.

The influence of the surface roughness of the cover plate 10 to ink jet characteristics is described referring to FIG. 10A. As shown, each side wall 6 is integral at a lower end thereof with the piezoelectric ceramics plate 2, and an upper end of each side wall 6 is bonded to the cover plate 10 by the adhesive 20. When the surface of the cover plate 10 is smooth, a very thin film of the adhesive 20 is formed between each side wall 6 and the cover plate 10, and a bonded portion formed by the adhesive 20 has a high rigidity. On the other hand, when the surface of the cover plate 10 is rough, a large amount of the adhesive 20 is interposed between each side wall 6 and the cover plate 10 as shown in FIG. 10B to cause a low rigidity of the bonded portion. As a result, the pressure generated in each ink chamber 4 upon jetting of ink droplets cannot be sufficiently increased, so that a desired volume of the ink droplets cannot be obtained.

The volume of ink droplets jetted was measured by using the cover plates 10 having different surface roughnesses.

In the ink jet apparatus 1 used in this test, the width W of each side wall 6 was set to 80 μm, the depth H of each groove 3 equal to the height of each side wall 6 was set to 400 μm, and the width b of each groove 3 was set to 80 μm. Lead zirconate titanate (PZT) piezoelectric ceramics were used as the materials of the piezoelectric ceramics plate 2 and each cover plate 10. An aluminum film having a thickness of about 1 μm formed by vapor deposition was used as each metal electrode 8. Further, an epoxy adhesive was used as the adhesive 20. The thickness k of each cover plate 10 was set to 1 mm, and the surface roughness of the surface to be bonded to each side wall 6 was changed from 1 to 8 μm. Further, to eliminate any influences other than the influence of the surface roughness, the adhesive 20 was applied uniformly and thinly in all the cover plates 10 having the different surface roughnesses. The volume of ink droplets was calculated by measuring the weight of a predetermined number of the ink droplets with use of a high-precision analysis balance and by using the weight thus measured and the density of the ink.

Figure 11:
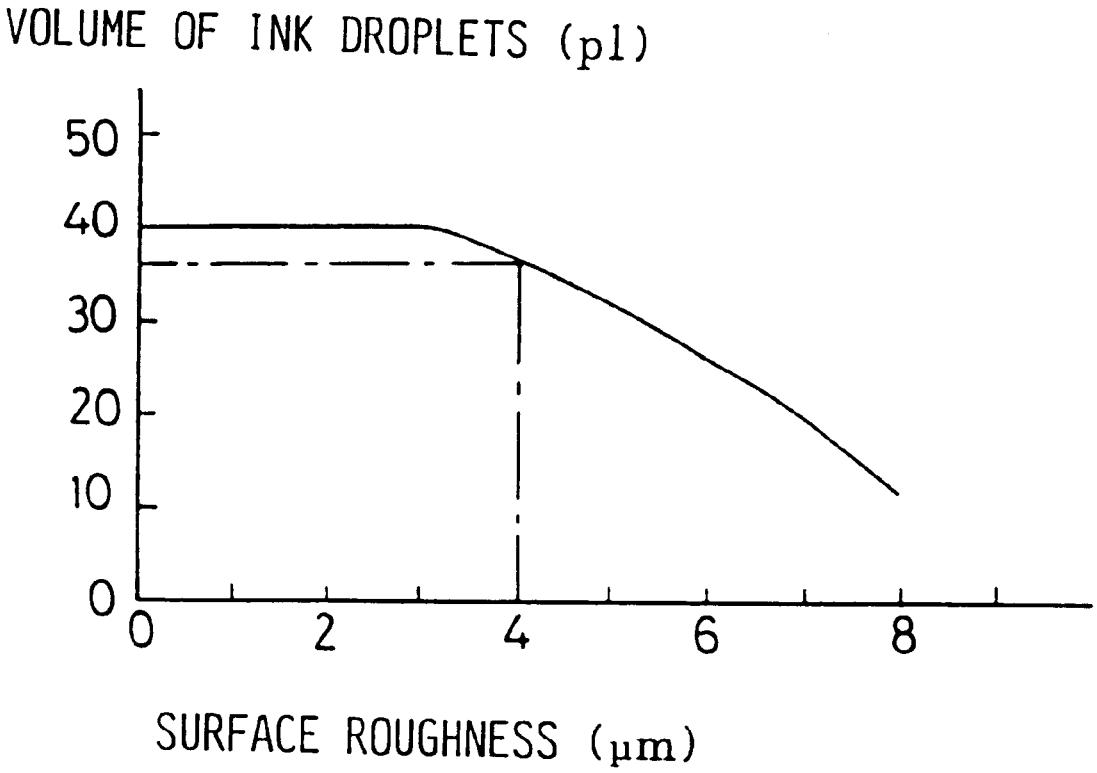
FIG. 11 is a graph showing the relation between the surface roughness of the cover plate and the volume of ink droplets.

As is apparent from FIG. 11, when the surface roughness of the cover plate 10 is 3 μm or less, the volume of the ink droplets is maximum and substantially constant. In comparison with this, when the surface roughness increases to about 4 μm, the volume of the ink droplets decreases about 10%. Further, when the surface roughness increases to about 5 μm or more, the volume of the ink droplets decreases 20% or more, causing a remarkable reduction in formation efficiency of the ink droplets.

Another jet test using the ink jet apparatus 1 having any dimensions other than the above dimensions was carried out. As the result of this test, an absolute amount of the volume of ink droplets changes, but a manner of change due to the surface roughness of the cover plate 10 is similar to that shown in FIG. 11.

Further, even when any adhesive (e.g., phenol adhesive) other than the epoxy adhesive is used, a tendency similar to that shown in FIG. 11 is exhibited.

Consequently, in the ink jet apparatus 1 according to this preferred embodiment, the surface roughness of the cover plate 10 is set to 5 μm or less, preferably 3 μm or less.

Because the surface roughness of the cover plate 10 is set to 5 μm or less, preferably 3 μm or less, the ratio of the pressure generated in each ink chamber 4 to the driving voltage applied to each metal electrode 8 is large. Accordingly, a high pressure can be generated in each ink chamber 4 by applying a low driving voltage, and ink droplets can be jetted with a speed and a volume enough to form print images. According to the ink jet apparatus 1 of this preferred embodiment, ink droplets can be jetted with a speed of about 3 to 8 m/sec and a volume of about 30 to 90 pl, which depends on the length of each ink chamber 4, by applying a low driving voltage of about 20 to 50 volts. Thus, a driving circuit can be manufactured at a low cost with a small size. The ink jet apparatus 1 as a whole can therefore be manufactured at a low cost with a small size.

Figure 12A:
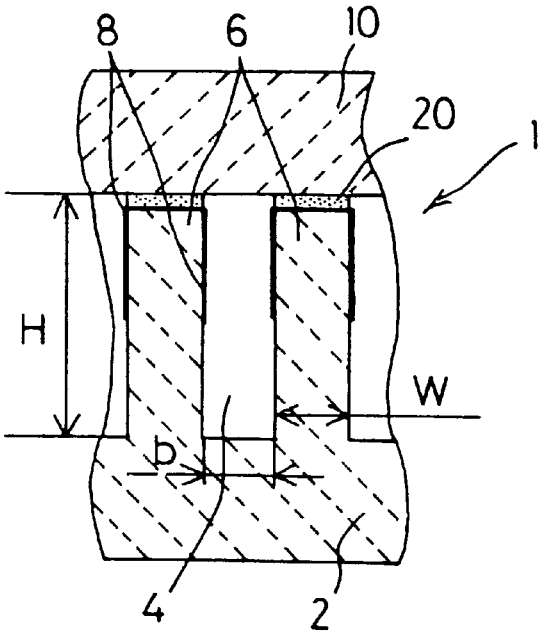
FIG. 12A is a partial sectional view similar to FIG. 10A, showing the condition where an adhesive for bonding a piezoelectric ceramics plate and the cover plate is heated to be hardened when a coefficient of linear expansion of the piezoelectric ceramics plate is different from that of the cover plate.

The influence of a difference in material between the piezoelectric ceramics plate 2 and the cover plate 10 to the endurance of the ink jet apparatus 1 is described referring to FIG. 12A. As shown, the piezoelectric ceramics plate 2 of the ink jet apparatus 1 is formed with a plurality of grooves 3 each forming an ink chamber 4 and with a plurality of side walls 6 partitioning the grooves 3. The width b of each groove 3 is set to 80 μm, and the depth H of each groove 3 is set to 400 μm. The width W of each side wall 6 is set to 80 μm. The upper end surface of each side wall 6 is bonded to the cover plate 10 by an adhesive 20. A thermosetting adhesive such as an epoxy adhesive is used as the adhesive 20. The adhesive 20 is hardened by heating up to about 160° C. The thickness of the cover plate 10 is set to 1 mm.

Figure 12B:
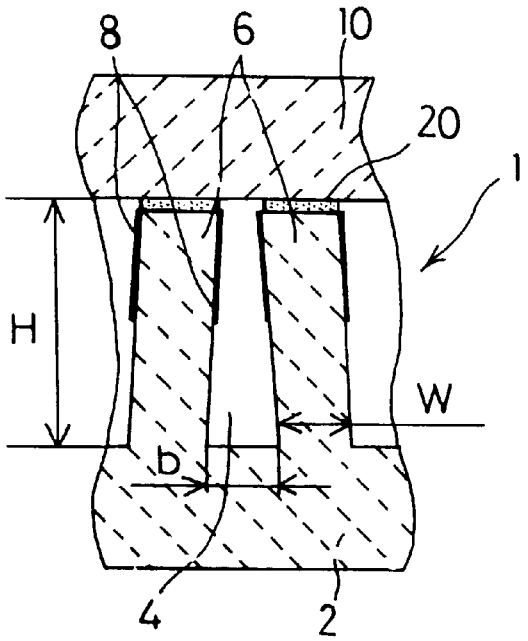
FIG. 12B is a partial sectional view similar to FIG. 12A, showing the condition where the adhesive heated to be hardened is returned to ordinary temperature.

In the ink jet apparatus 1 as mentioned above, the material of the piezoelectric ceramics plate 2 is not necessarily the same as the material of the cover plate 10. Accordingly, when the material of the piezoelectric ceramics plate 2 has a coefficient of linear expansion different from that of the material of the cover plate 10, the deformation of both members becomes nonuniform when the temperature of the adhesive 20 after being hardened by heating is returned to ordinary temperature. As a result, even when each side wall 6 is bonded to the cover plate 10 at about 160° C. in such a manner that the adjacent side walls 6 are parallel to each other as shown in FIG. 12A, the side walls 6 are deformed after reaching ordinary temperatures as shown in FIG. 12B, a residual stress is generated in each side wall 6 and the adhesive 20 reducing the strength of a bonded portion, in particular.

In general, the magnitude of the residual stress is dependent upon not only a difference in coefficient of linear expansion but also an elastic modulus (Young's modulus) of material. In the ink jet apparatus 1 of this preferred embodiment, however, the cover plate 10 is sufficiently thick as compared with each side wall 6. Thus, the influence caused by a change in Young's modulus due to a difference in material of the cover plate 10 is substantially insignificant.

Then, the influence of the above phenomenon to the life of the ink jet apparatus 1 was examined. By using three kinds of lead zirconate titanate (PZT) piezoelectric ceramics having three coefficients of linear expansion of 1, 2, and 4 ppm/° C., three kinds of piezoelectric ceramics plates 2 having different coefficients of linear expansion were prepared. Further, three kinds of cover plates 10 having the same materials as those of the above piezoelectric ceramics plates 2 were prepared. Additionally, three kinds of cover plates 10 made of magnesia (MgO), zirconia ($ZrO_2$), and alumina ($Al_2O_3$) were prepared. Thus, six kinds of cover plates 10 having different coefficients of linear expansion were totally prepared.

By using the various kinds of piezoelectric ceramics plates 2 and the various kinds of cover plates 10 mentioned above, various ink jet apparatuses 1 were prepared. Then, driving pulses at a voltage level of 40 volts continued to be applied at a frequency of 8 kHz to each ink jet apparatus 1. At this time, the number of times of the applied driving pulses was measured until the jet function of each ink jet apparatus 1 was reduced to a degree such that ink droplets could not be formed.

The result of measurement is shown in FIG. 13. As is apparent from FIG. 13, when the difference in coefficient of linear expansion between the piezoelectric ceramics plate 2 and the cover plate 10 is 6.0 ppm/° C. or less, the life of the ink jet apparatus 1 is $30\times10^8$ times. In contrast, when the difference in coefficient of linear expansion becomes 8.5 ppm/° C., the life decreases to $20\times10^8$ times. Further, when the difference in coefficients of linear expansion becomes larger, the life decreases more remarkably.

While an epoxy adhesive is used as the adhesive 20 in this preferred embodiment, any other thermosetting adhesives such as a phenol adhesive may be used. Also in these cases, a tendency similar to that shown in FIG. 13 is exhibited.

Consequently, in the ink jet apparatus 1 of this preferred embodiment, the difference in coefficients of linear expansion between the piezoelectric ceramics plate 2 and the cover plate 10 is set to 8.5 ppm/° C. or less, preferably 6.0 ppm/° C. or less.

Because the difference in coefficients of linear expansion between the piezoelectric ceramics plate 2 and the cover plate 10 is set to 8.5 ppm/° C. or less, preferably 6.0 ppm/° C. or less, the jet life of the ink jet apparatus 1 becomes at least about $20\times10^8$ times, preferably $30\times10^8$ times which is sufficient in practical use. Accordingly, the ink jet apparatus 1 can be sufficiently applied to not only printing of character images but also printing of graphics images requiring a great frequency of jets of ink. Accordingly, the number of replacements of the ink jet apparatus 1 in a printer can be reduced, and the reliability of the printer can be improved.

Figure 14:
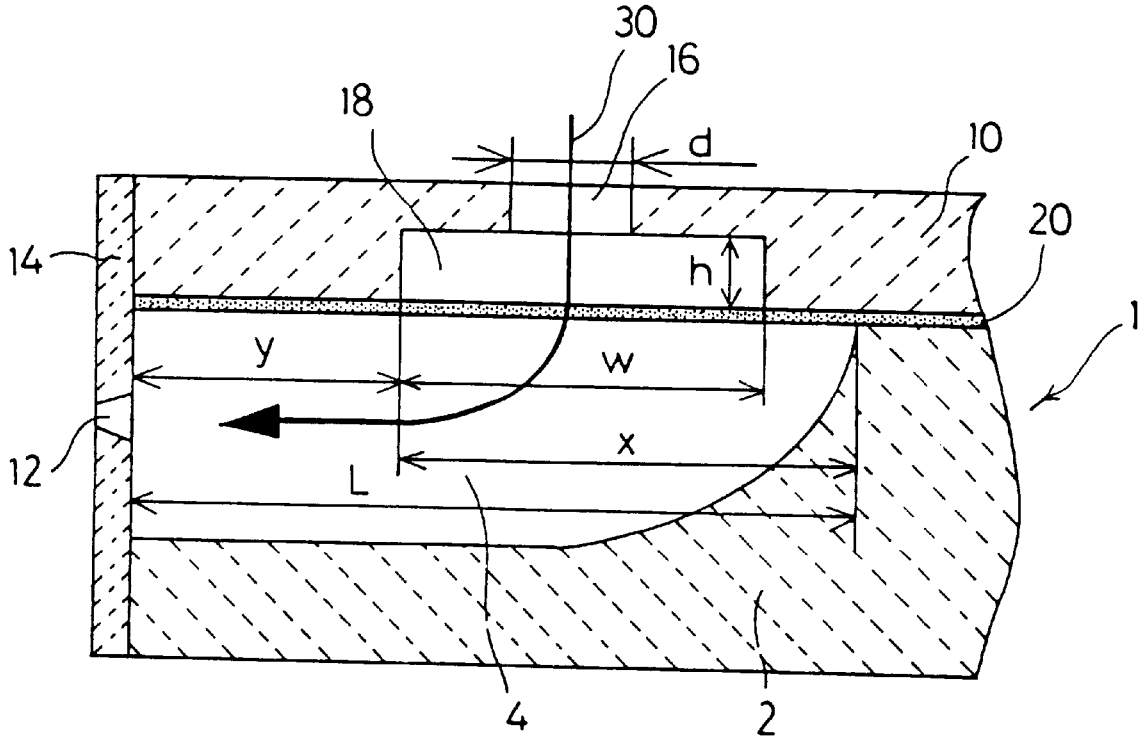
FIG. 14 is an enlarged partial sectional view similar to FIG. 1A, showing the position of the manifold relative to each ink chamber.

The relative positional relationship between each ink chamber 4 and the manifold 18 is described referring to FIG. 14 which shows a cross section of the ink jet apparatus 1 as viewed from one side thereof. As shown by an arrow 30 in FIG. 14, ink is supplied from an ink tank (not shown) through an ink supply tube (not shown) into the ink inlet hole 16. Then, the ink is supplied from the ink inlet hole 16 through the manifold 18 into each ink chamber 4. In a test using the ink jet apparatus 1, lead zirconate titanate (PZT) piezoelectric ceramics were used as the materials of the piezoelectric ceramics plate 2 and the cover plate 10. To examine a change in volume of ink droplets due to a change in relative positional relationship between the manifold 18 and each ink chamber 4, various ink jet apparatuses 1 were prepared having different distances x from the front side surface of the manifold 18 to the rear end surface of each ink chamber 4. However, in each ink jet apparatus 1, the full length L of each ink chamber 4 was set to 17 mm. Further, in each ink jet apparatus 1, the depth h of the manifold 18 was set to 0.5 mm, and the width w of the manifold 18 was set to 5 mm. The volume of ink droplets was calculated by measuring the weight of a predetermined number of the ink droplets jetted with use of a high-precision analysis balance and by using the weight thus measured and the density of the ink.

Figure 15:
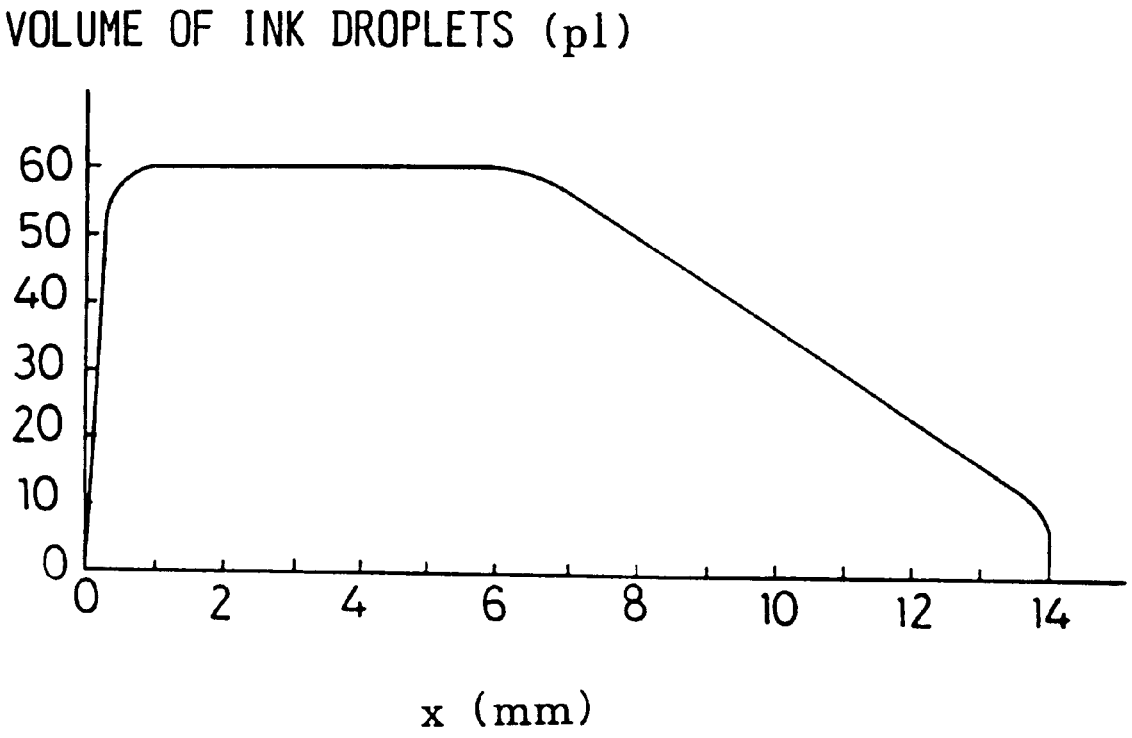
FIG. 15 is a graph showing the relation between the position of the manifold and the volume of ink droplets.
Figure 16:
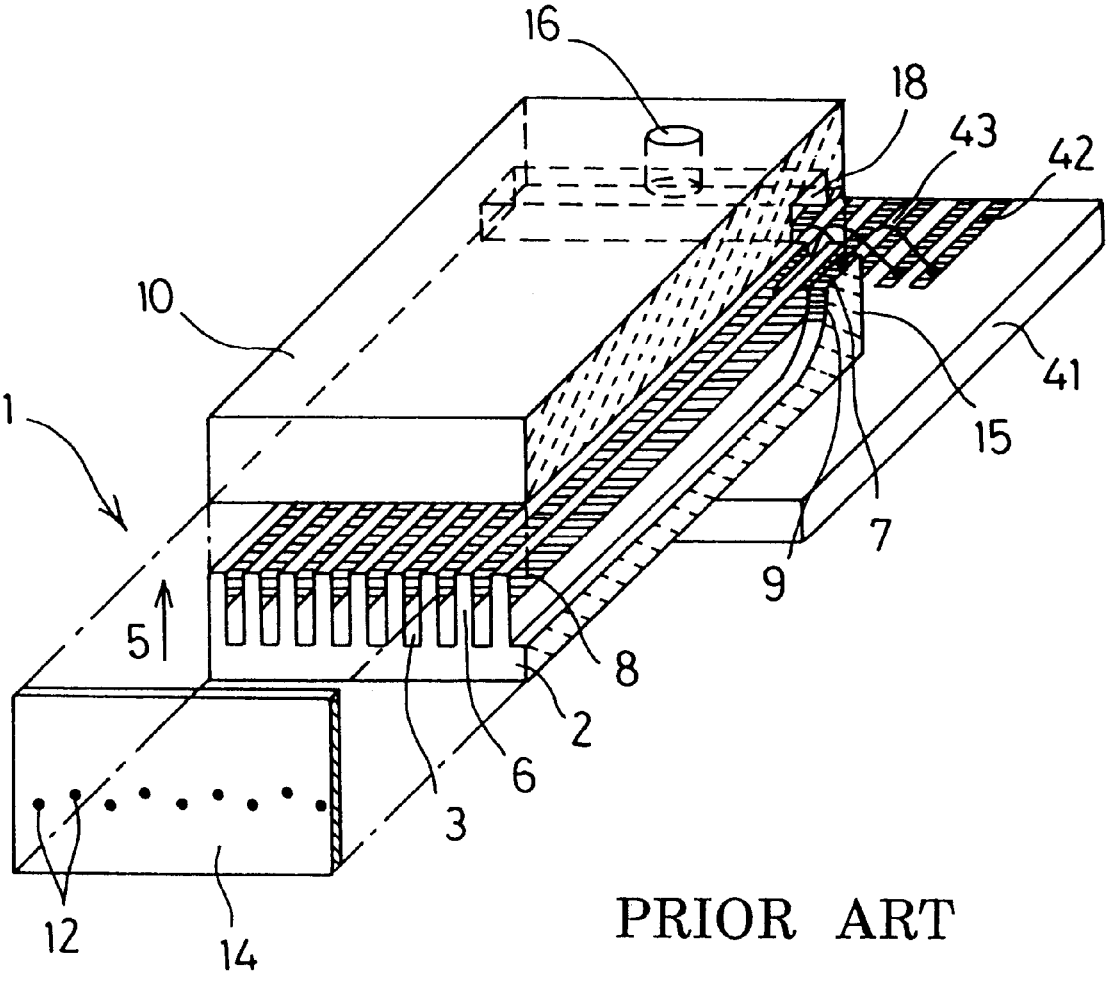
FIG. 16 is a partially cutaway perspective view of a shear mode type ink jet apparatus in the prior art.
Figure 17:
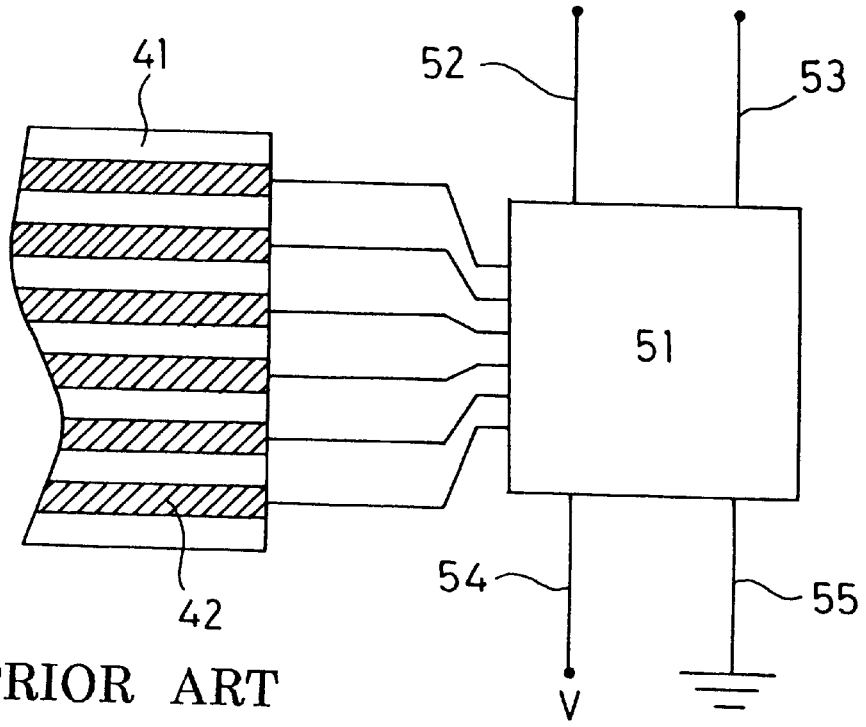
FIG. 17 is a schematic diagram of a control section of the ink jet apparatus shown in FIG. 16.
Figure 18:
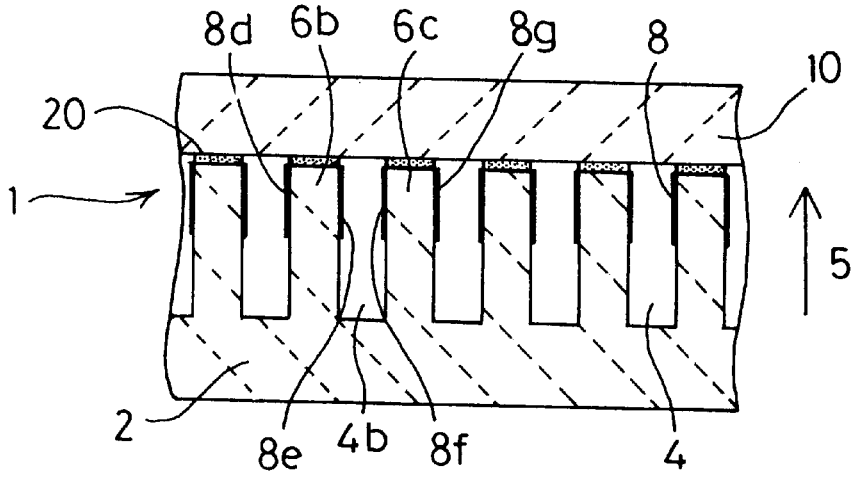
PRIOR ART Fig.18
FIG. 18 is a partial sectional view of the ink jet apparatus shown in FIG. 16.
Figure 19:
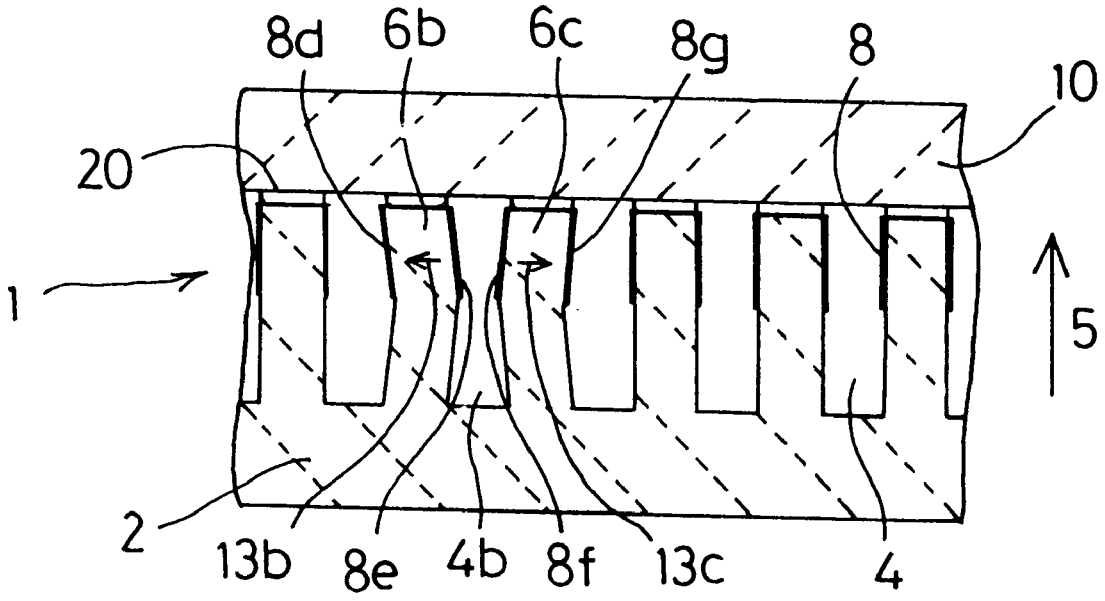
FIG. 19 is a partial sectional view similar to FIG. 18, showing the operation of the ink jet apparatus.

Using the above various ink jet apparatuses 1 having different relative positional relationship between the manifold 18 and each ink chamber 4, the volume of ink droplets jetted from each ink jet apparatus 1 was measured. The result of measurement is shown in FIG. 15, in which the axis of abscissa represents the distance x between the front side surface of the manifold 18 and the rear end surface of each ink chamber 4, and the axis of ordinate represents the volume of ink droplets. As is apparent from FIG. 15, when the distance x ranges between 1 mm and 6 mm, the volume of ink droplets reaches a maximum value of 60 pl, which is kept substantially constant.

When the distance x becomes 1 mm or less, the volume of ink droplets rapidly decreases. Further, when the distance x decreases to about 0.2 mm, the ink cannot be jetted. That is, x=1 means that the distance of overlap between the manifold 18 and each ink chamber 4 is equal to 1 mm, and a decrease in the distance x down from 1 mm causes the ink flow into each ink chamber 4 to become rapidly hard.

On the other hand, when the distance x becomes 6 mm or more, the volume of ink droplets does not decrease as rapidly. This is due to the fact that an increase in the distance x results in an approach of the manifold 18 to a nozzle plate 14, that is, the distance y between the front side surface of the manifold 18 and the inner surface of the nozzle plate 14. When the pressure in each ink chamber 4 is increased to jet the ink droplets from a nozzle 12 formed through the nozzle plate 14, the ink in each ink chamber 4 is forced from the nozzle 12. Simultaneously, it reversely flows from the manifold 18 into the ink inlet hole 16. As a result, the pressure near the manifold 18 is rapidly reduced to generate a negative pressure wave. When this negative pressure wave reaches the nozzle 12, the ink jet from the nozzle 12 is stopped. The shorter the distance y, the shorter the time of reach of the negative pressure wave to the nozzle 12. Accordingly, when the distance y is reduced, the ink jet from the nozzle 12 is quickly stopped to result in a reduction in the volume of ink droplets.

As is apparent from FIG. 15, when the distance x becomes about 11 mm (y=L−x=6 mm), the volume of ink droplets becomes about 30 pl, i.e., half of the maximum value. Further, when the distance x increases up to 14 mm (y=3 mm) or more, the ink droplets cannot be jetted. While the volume of ink droplets may be adjusted more or less by controlling the applied driving pulse, the relative positional relationship between the manifold 18 and each ink chamber 4 must be defined so that the distance x is set to 0.2 mm or more and the distance y is set to 3 mm or more, preferably 6 mm or more.

While the depth h and the width w of the manifold 18 were set to 0.5 mm and 5 mm, respectively, in the above test, a tendency similar to that shown in FIG. 15 is exhibited even when the dimensions of the manifold 18 vary from the above values.

Further, while the full length L of each ink chamber 4 was set to 17 mm in the above test, a tendency similar to that shown in FIG. 15 is exhibited even when the full length L varies from 17 mm.

Consequently, in the ink jet apparatus 1 according to this preferred embodiment, the position of the manifold 18 to be formed in the cover plate 10 relative to each ink chamber 4 is such that the distance between the front side surface of the manifold 18 and the rear end surface of each ink chamber 4 is set to 0.2 mm or more. Also, the distance between the front side surface of the manifold 18 and the inner surface of the nozzle plate 14 is set to 3 mm or more, preferably 6 mm or more.

Because the distance between the front side surface of the manifold 18 and the rear end surface of each ink chamber 4 is set to 0.2 mm or more and the distance between the front side surface of the manifold 18 and the inner surface of the nozzle plate 14 is set to 3 mm or more, preferably 6 mm or more, the ink droplets can be efficiently jetted and the ink can be smoothly supplied to each ink chamber 4. Accordingly, the ink droplets can be jetted with a speed and a volume sufficient to form print images. According to the ink jet apparatus 1 of this preferred embodiment, ink droplets can be jetted with a speed of about 3 to 8 m/sec and a volume of about 30 to 90 pl by applying a low driving voltage of about 20 to 50 volts. Thus, a driving circuit can be manufactured at a low cost with a small size. The ink jet apparatus 1 as a whole can therefore be manufactured at a low cost with a small size.

It is to be noted that the present invention is not limited to the preferred embodiment described above, but various modifications may be made without departing from the scope of the present invention.

For example, while the ink jet apparatus 1 of the preferred embodiment is of a shear mode type, such that the ink in each ink chamber 4 is jetted by the shear mode deformation of each side wall 6 made of piezoelectric ceramics, the ink jet apparatus according to the present invention may be another type, such as a Kaiser type or a thermal jet type as mentioned previously.

What is claimed is:

1. An ink jet printing apparatus comprising:

a plate with a plurality of spaced longitudinally extending upstanding walls defining parallel ink chambers therebetween, each of said ink chambers having a front end and a rear end;

a nozzle assembly coupled to said plate at said front end of said ink chambers and having nozzles formed therein, said nozzles being aligned with said ink chambers; and a cover coupled to said plate and closing said ink chambers, said cover including an ink manifold having a front side and a rear side and being in communication with said ink chambers and including an ink inlet in said manifold for introducing ink into said manifold, wherein a distance between said front side of said manifold and said rear end of said ink chambers is at least 0.2 mm and a distance between said front side of said manifold and said front end of said ink chambers at said nozzle is at least 3 mm, wherein the ink manifold is positioned with respect to each ink chamber to control a volume of ink droplets jetted from the nozzles to ensure maximum efficiency in jetting.

2. The ink jet printing apparatus of claim 1 wherein said distance between said front side of said manifold and said front end of said ink chambers at said nozzle is at least 6 mm.

3. The ink jet printing apparatus of claim 1 wherein said ink inlet has a diameter of at least 0.2 mm.

4. The ink jet printing apparatus of claim 1 wherein said manifold has a depth of at least 0.2 mm.

5. The ink jet printing apparatus of claim 1 wherein each of said ink chambers has a sectional area and said manifold has a sectional area, and wherein the sectional area of said manifold is in a range of 0.5 to 5 times the sectional area of all of said ink chambers combined.

6. The ink jet apparatus of claim 1 wherein each of said ink chambers has a depth and said cover has a thickness, and wherein said depth times said thickness is $\geqq 0.2\ mm^2$.

7. The ink jet apparatus of claim 1 wherein said cover has a surface that faces said plate and said surface has a roughness of 5 $\mu$m or less.

8. The ink jet apparatus of claim 1 wherein said plate has a coefficient of linear expansion and said cover has a coefficient of linear expansion, and wherein said coefficients of linear expansion of said plate and said cover differ by 8.5 ppm/° C. or less.

9. An ink jet printing apparatus comprising:

a plate with a plurality of spaced longitudinally extending upstanding walls defining parallel ink chambers therebetween, each of said ink chambers having a front end and a rear end;

a nozzle assembly coupled to said plate at said front end of said ink chambers and having nozzles formed therein, said nozzles being aligned with said ink chambers; and a cover coupled to said plate and closing said ink chambers, said cover including an ink manifold having a front side and a rear side and being in communication with said ink chambers and including an ink inlet in said manifold for introducing ink into said manifold, wherein each of said ink chambers has a depth and said cover has a thickness, and wherein said depth times said thickness is $\geqq 0.2\ mm^2$, which suppresses deformation of said cover.

10. The ink jet printing apparatus of claim 9 wherein said ink inlet has a diameter of at least 0.2 mm.

11. The ink jet printing apparatus of claim 9 wherein said manifold has a depth of at least 0.2 mm.

12. The ink jet printing apparatus of claim 9 wherein each of said ink chambers has a sectional area and said manifold has a sectional area, and wherein the sectional area of said manifold is in a range of 0.5 to 5 times the sectional area of all of said ink chambers combined.

13. The ink jet apparatus of claim 9 wherein said cover has a surface that faces said plate and said surface has a roughness of 5 $\mu$m or less.

14. The ink jet apparatus of claim 9 wherein said plate has a coefficient of linear expansion and said cover has a coefficient of linear expansion, and wherein said coefficients of linear expansion of said plate and said cover differ by 8.5 ppm/° C. or less.

15. An ink jet printing apparatus comprising:

a plate with a plurality of spaced longitudinally extending upstanding walls defining parallel ink chambers therebetween, each of said ink chambers having a front end and a rear end;

a nozzle assembly coupled to said plate at said front end of said ink chambers and having nozzles formed therein, said nozzles being aligned with said ink chambers; and a cover coupled to said plate and closing said ink chambers, said cover including an ink manifold having a front side and a rear side and being in communication with said ink chambers and including an ink inlet in said manifold for introducing ink into said manifold, wherein said ink inlet has a diameter of at least 0.2 mm and a cross sectional shape sized to create a laminar flow of ink into said manifold thus avoiding a turbulent flow state and therefore reducing a total flow loss to obtain a stable flow of ink.

16. The ink jet printing apparatus of claim 15 wherein said manifold has a depth of at least 0.2 mm.

17. The ink jet printing apparatus of claim 15 wherein each of said ink chambers has a sectional area and said manifold has a sectional area, and wherein the sectional area of said manifold is in a range of 0.5 to 5 times the sectional area of all of said ink chambers combined.

18. The ink jet apparatus of claim 15 wherein said plate has a coefficient of linear expansion and said cover has a coefficient of linear expansion, and wherein said coefficients of linear expansion of said plate and said cover differ by 8.5 ppm/° C. or less.

19. An ink jet printing apparatus comprising:

a plate with a plurality of spaced longitudinally extending upstanding walls defining parallel ink chambers therebetween, each of said ink chambers having a front end and a rear end;

a nozzle assembly coupled to said plate at said front end of said ink chambers and having nozzles formed therein, said nozzles being aligned with said ink chambers; and a cover coupled to said plate and closing said ink chambers, said cover including an ink manifold having a front side and a rear side and being in communication with said ink chambers and including an ink inlet in said manifold for introducing ink into said manifold, wherein each of said ink chambers has a sectional area and said manifold has a sectional area, and wherein the sectional area of said manifold is at least 0.5 times and at most 5 times the sectional area of all of said ink chambers combined, wherein a total flow resistance is reduced by creating an insignificant flow resistance in the manifold compared to flow resistance in the ink chambers for smooth introduction of ink in each chamber to generate a high pressure with a low driving voltage for jetting ink droplets having sufficient speed and uniform volume.

20. The ink jet printing apparatus of claim 19 wherein said manifold has a depth of at least 0.2 mm.

21. The ink jet apparatus of claim 19 wherein said plate has a coefficient of linear expansion and said cover has a coefficient of linear expansion, and wherein said coefficients of linear expansion of said plate and said cover differ by 8.5 ppm/° C. or less.

22. An ink jet printing apparatus comprising:

a plate with a plurality of spaced longitudinally extending upstanding walls defining parallel ink chambers therebetween, each of said ink chambers having a front end and a rear end;

a nozzle assembly coupled to said plate at said front end of said ink chambers and having nozzles formed therein, said nozzles being aligned with said ink chambers; and a cover coupled to said plate and closing said ink chambers, said cover including an ink manifold having a front side and a rear side and being in communication with said ink chambers and including an ink inlet in said manifold for introducing ink into said manifold, wherein said plate and said cover are made of different materials, and said plate has a coefficient of linear expansion and said cover has a coefficient of linear expansion, and wherein said coefficients of linear expansion of said plate and said cover differ by a value less than or equal to 8.5 ppm/° C. and greater than 0.

23. The ink jet apparatus of claim 22 wherein said coefficients of linear expansion of said plate and said cover differ by 6.0 ppm/° C. or less.

24. The ink jet apparatus of claim 22 wherein said plate and said cover are bonded together with thermosetting adhesive.

25. The ink jet apparatus of claim 22 wherein said ink inlet has a diameter of at least 0.2 mm and said manifold has a depth of at least 0.2 mm.

26. The ink jet apparatus of claim 25 wherein a distance between said front side of said manifold and said rear end of said ink chambers is at least 0.2 mm and a distance between said front side of said manifold and said front end of said ink chambers at said nozzle is at least 3 mm.

27. The ink jet printing apparatus of claim 26 wherein each of said ink chambers has a sectional area and said manifold has a sectional area, and wherein the sectional area of said manifold is in a range of 0.5 to 5 times the sectional area of all of said ink chambers combined.

28. The ink jet apparatus of claim 27 wherein each of said ink chambers has a depth and said cover has a thickness, and wherein said depth times said thickness is $\geqq 0.2\ mm^2$.

29. The ink jet apparatus of claim 28 wherein said cover has a surface that faces said plate and said surface has a roughness of 5 $\mu$m or less.

* * * * *